US011776487B2

(12) United States Patent
Ota

(10) Patent No.: US 11,776,487 B2
(45) **Date of Patent: *Oct. 3, 2023**

(54) DA CONVERSION CIRCUIT, ELECTRO-OPTICAL DEVICE AND ELECTRONIC APPARATUS

(71) Applicant: SEIKO EPSON CORPORATION, Tokyo (JP)

(72) Inventor: Hitoshi Ota, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/981,116

(22) Filed: Nov. 4, 2022

(65) Prior Publication Data

US 2023/0057826 A1 Feb. 23, 2023

Related U.S. Application Data

(63) Continuation of application No. 17/847,576, filed on Jun. 23, 2022.

(30) Foreign Application Priority Data

Jun. 24, 2021 (JP) ..... 2021-104755

(51) Int. Cl.
*G09G 3/3291* (2016.01)

(52) U.S. Cl.
CPC ... *G09G 3/3291* (2013.01); *G09G 2300/0426* (2013.01); *G09G 2300/0828* (2013.01);
(Continued)

(58) Field of Classification Search
CPC ... G09G 2300/0828; G09G 2300/0426; G09G 2300/0876; G09G 2310/027; G09G 3/3291
See application file for complete search history.

(56) References Cited

U.S. PATENT DOCUMENTS

2002/0163457 A1 11/2002 Azami et al.
2012/0133534 A1 5/2012 Oshima
(Continued)

FOREIGN PATENT DOCUMENTS

JP H11-112349 A 4/1999
JP 2000-341125 A 12/2000
(Continued)

OTHER PUBLICATIONS

Feb. 6, 2023 Office Action issued in U.S. Appl. No. 17/847,576.

*Primary Examiner* — Kenneth B Lee, Jr.
(74) *Attorney, Agent, or Firm* — Oliff PLC

(57) ABSTRACT

A first capacitance element provided corresponding to a bit D0, a second capacitance element provided corresponding to a bit D1, and a third capacitance element and a fourth capacitance element provided corresponding to a bit D2, and electrically coupled in parallel are included. An area S1 where electrodes of the first capacitance element overlap in plan view is smaller than half an area S2 where electrodes of the second capacitance element overlap in plan view, an area in which electrodes of the third capacitance element overlap in plan view is substantially the same as the area S2, and an area where electrodes of the fourth capacitance element overlap in plan view is substantially the same as the area S2.

17 Claims, 17 Drawing Sheets

(52) U.S. Cl.
CPC ..... *G09G 2300/0876* (2013.01); *G09G 2310/027* (2013.01)

(56) References Cited

U.S. PATENT DOCUMENTS

| | | | | |
|---|---|---|---|---|
| 2013/0182803 | A1 | 7/2013 | Ishii et al. | |
| 2015/0256190 | A1 | 9/2015 | Takayama | |
| 2022/0415265 | A1 * | 12/2022 | Ota ..... | G09G 3/3291 |

FOREIGN PATENT DOCUMENTS

| | | | |
|---|---|---|---|
| JP | 2012-114756 | A | 6/2012 |
| JP | 2013-150117 | A | 8/2013 |
| JP | 2015-076824 | A | 4/2015 |
| JP | 2015-171087 | A | 9/2015 |

* cited by examiner

DA CONVERSION CIRCUIT, ELECTRO-OPTICAL DEVICE AND ELECTRONIC APPARATUS

The present application is a continuation of U.S. application Ser. No. 17/847,576 filed Jun. 23, 2020, which is based on, and claims priority from JP Application Serial Number 2021-104755, filed Jun. 24, 2021, the disclosure of which is hereby incorporated by reference herein in its entirety.

BACKGROUND

1. Technical Field

The present disclosure relates to a DA conversion circuit, an electro-optical device and an electronic apparatus.

2. Related Art

An electro-optical device using, for example, an OLED as a display element has been known. OLED is an abbreviation for Organic Light Emitting Diode. In this electro-optical device, a pixel circuit including a transistor for causing a current to flow through the display element is provided corresponding to each pixel of a display image. The transistor supplies a current corresponding to a luminance level to the display element. As a result, the display element emits light at luminance corresponding to the current.

In the electro-optical device described above, a voltage corresponding to luminance is applied to a gate node of the transistor via a data line. More specifically, data that specifies luminance is converted to an analog voltage by a DA conversion circuit, and applied to the gate node of the transistor via the data line.

As a technique applied to such a DA conversion circuit, for example, the following technique has been known. Specifically, a technique has been known in which, in a configuration in which a capacitance value corresponding to an input bit string is selected, a capacitance element corresponding to a digit of a first bit at the last position, of the bit string, is used as a basic capacitance element, and the basic capacitance elements are arranged by weighting (power of 2) corresponding to digits from a second bit to a fourth bit (see, for example, JP 2015-76824 A).

However, in the technique described in JP 2015-76824 A, one, two, four, and eight of the basic capacitance elements in order are required corresponding to the respective first bit to fourth bits. Therefore, there is a problem that a wide space is required for providing the capacitance elements.

SUMMARY

A DA conversion circuit according to an aspect of the present disclosure includes a capacitance element unit including a capacitance element having a capacitance value corresponding to a weight of a bit, wherein the capacitance element unit includes a first capacitance element provided corresponding to a first bit, a second capacitance element provided corresponding to a second bit having a greater weight than that of the first bit, and a third capacitance element and a fourth capacitance element, provided corresponding to a third bit having a greater weight than that of the second bit, and electrically coupled in parallel, the first capacitance element includes a first electrode and a second electrode, the second capacitance element includes a third electrode and a fourth electrode, the third capacitance element includes a fifth electrode and a sixth electrode, the fourth capacitance element includes a seventh electrode and an eighth electrode, a first area in which the first electrode and the second electrode overlap in plan view is less than half a second area in which the third electrode and the fourth electrode overlap in plan view, an area in which the fifth electrode and the sixth electrode overlap in plan view is substantially the same as the second area, and an area in which the seventh electrode and the eighth electrode overlap in plan view is substantially the same as the second area.

BRIEF DESCRIPTION OF IRE DRAWINGS

DESCRIPTION OF EXEMPLARY EMBODIMENTS

A DA conversion circuit according to exemplary embodiments of the present disclosure will be described below with reference to the accompanying drawings.

Note that, in each figure, a size and a scale of each unit is different from the actual size and the actual scale of each unit as appropriate. Moreover, the exemplary embodiments described below are suitable specific examples, and various technically preferable limitations are applied, but the scope of the disclosure is not limited to these modes unless it is specifically described in the following description to limit the disclosure.

First Exemplary Embodiment

Figure 1:
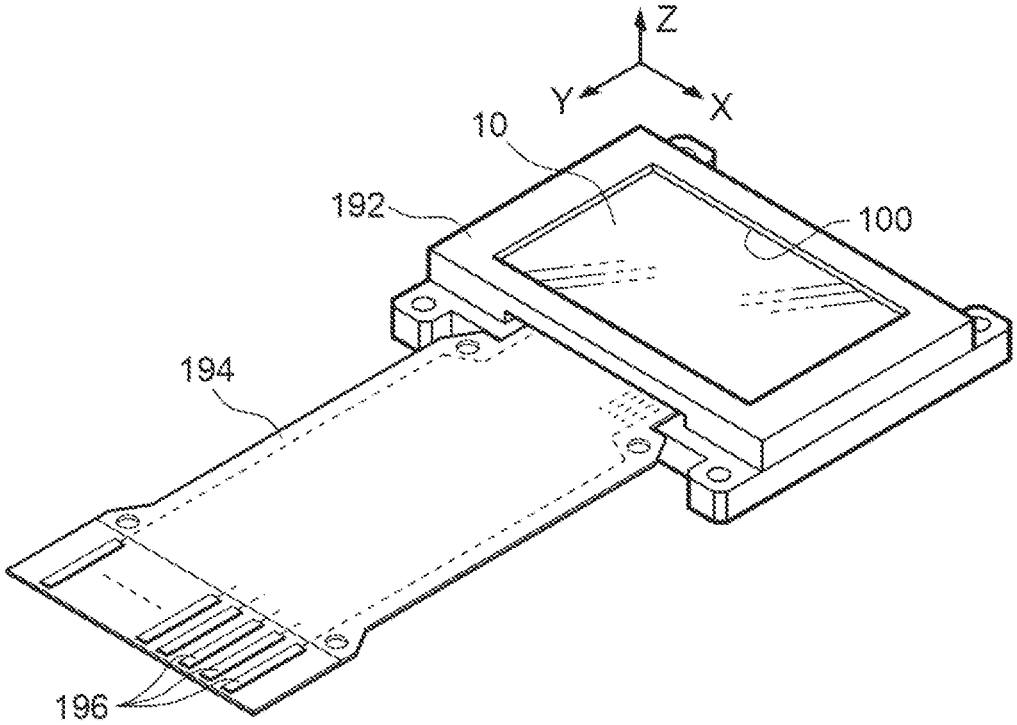
FIG. 1 is a perspective view of an electro-optical device to which a DA conversion circuit according to a first exemplary embodiment is applied.

FIG. 1 is a perspective view of an electro-optical device 10 to which a DA conversion circuit according to a first exemplary embodiment is applied. The electro-optical device 10 serves as a micro display panel configured to display an image in a head-mounted display, or the like, for example. The electro-optical device 10 includes a pixel circuit including a display element, a driving circuit configured to drive the pixel circuit, and the like. The pixel circuit and the driving circuit are integrated into a semiconductor substrate. The semiconductor substrate is typically a silicon substrate, but may be other semiconductor substrates.

The electro-optical device 10 is housed in a frame-shaped case 192 opening in a display region 100. The electro-optical device 10 is coupled to one end of an FPC substrate 194. Note that, FPC is an abbreviation for Flexible Printed Circuits. A plurality of terminals 196 coupled to a host device (not illustrated) are provided at another end of the FPC substrate 194. When the plurality of terminals 196 are coupled to the host device, the electro-optical device 10 is supplied with video data, synchronization signals, and the like via the FPC substrate 194 from the host device.

Note that, in the figure, an X direction indicates an extension direction of a scanning line in the electro-optical device 10, and a Y direction indicates the extension direction of a data line. A two-dimensional plane defined by the X direction and the Y direction is a substrate surface of the semiconductor substrate. A Z direction is perpendicular to the X direction and the Y direction, and is an emission direction of light emitted from the display element.

Figure 2:
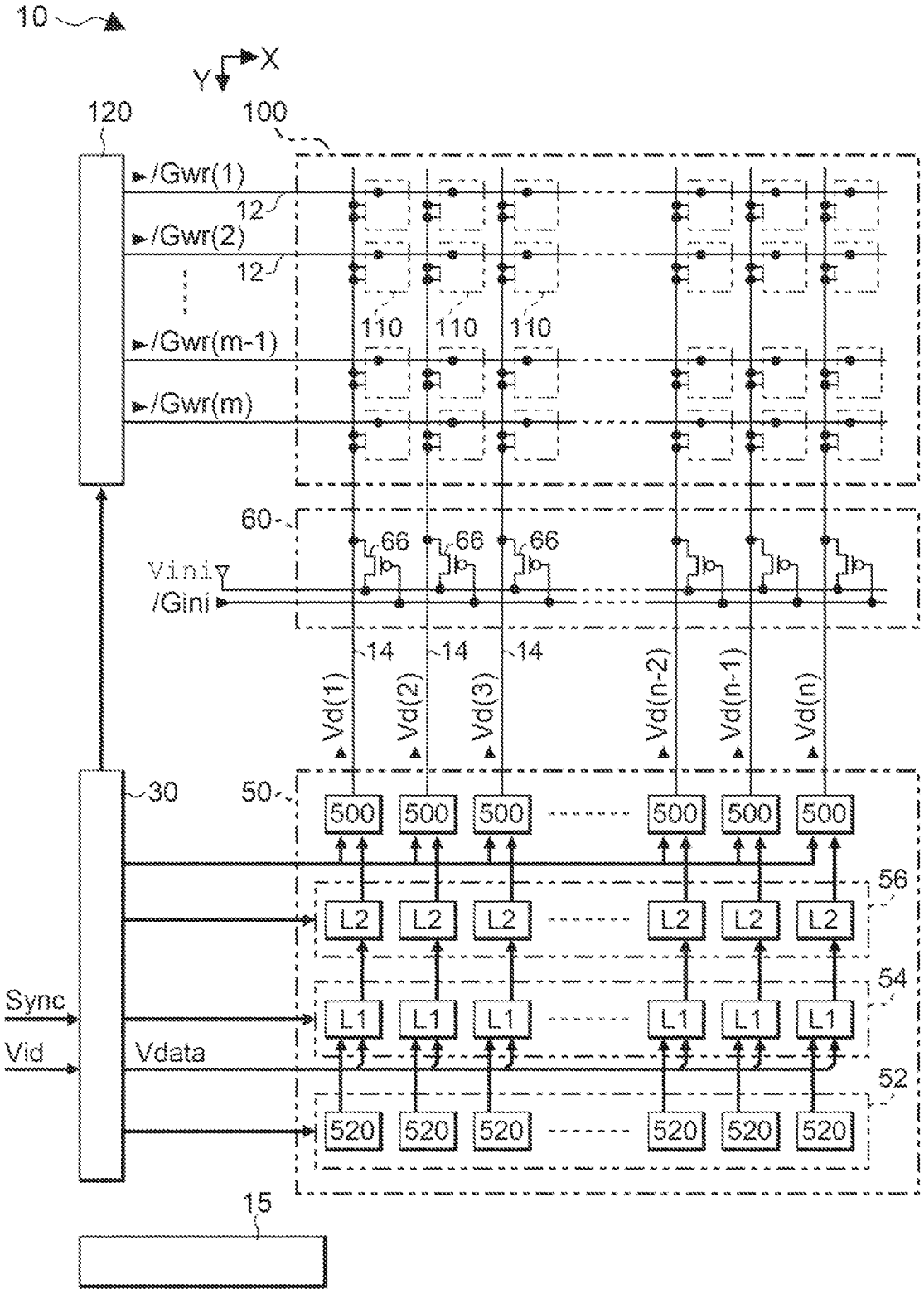
FIG. 2 is a block diagram illustrating an electrical configuration of an electro-optical device.

FIG. 2 is a block diagram illustrating an electrical configuration of the electro-optical device 10. As illustrated in the figure, the electro-optical device 10 is broadly classified into a power supply circuit 15, a control circuit 30, a data signal output circuit 50, an initialization circuit 60, a display region 100, and a scanning line driving circuit 120.

In the display region 100, m rows of scanning lines 12 are provided along the X direction in the figure, and n columns of data lines 14 are provided along the Y direction, so as to be mutually and electrically insulated from each scanning line 12. Note that, m and n are integers equal to or greater than 2.

In the display region 100, pixel circuits 110 are provided corresponding to intersections between the m rows of scanning lines 12 and the n columns of data lines 14. Thus, the pixel circuits 110 are arrayed in a matrix of vertical m rows by horizontal n columns. In the matrix array, in order to distinguish the rows from each other, the rows may be referred to as a 1st, 2nd, 3rd, . . . , (m−1)-th, and m-th row sequentially from a top in the figure. Similarly, in order to distinguish the columns in the matrix from each other, the columns may be referred to as a 1st, 2nd, 3rd, . . . , (n−1)-th, and n-th column sequentially from a left in the figure.

Note that, an integer i from 1 to m is used for generally describing the scanning lines 12. Similarly, an integer j from 1 to n is used for generally describing the data lines 14.

The control circuit 30 controls each unit based on video data Vid and a synchronization signal Sync supplied from the host device. The video data Vid specifies a gray scale level of a pixel in an image to be displayed, for example, with eight bits for each of three primary colors.

The synchronization signal Sync includes a vertical synchronization signal instructing a vertical scanning start of the video data Vid, a horizontal synchronization signal instructing a horizontal scanning start, and a dot clock signal indicating timing for one pixel portion of the video data.

A pixel of an image to be displayed in the present exemplary embodiment and the pixel circuit 110 in the display region 100 correspond to each other in a one-to-one manner.

Brightness characteristics indicated by a gray scale level in the video data Vid supplied from the host device, and luminance characteristics of an OLED included in the pixel circuit 110 do not necessarily match.

Thus, in order to cause the OLED to emit light at luminance corresponding to the gray scale level specified by the video data Vid, the control circuit 30 up-converts eight bits of the video data Vid to, for example, ten bits in the present exemplary embodiment, and outputs the ten bits, as video data Vdata. Thus, the 10-bit video data Vdata is data corresponding to the gray scale level specified by the video data Vid.

Note that, for the up-conversion, a look-up table is used in which the correspondence between the eight bits of the video data Vid as input and the ten bits of the video data Vdata as output is stored in advance. Further, the control circuit 30 generates various control signals to control each unit, but details will be described below.

The scanning line driving circuit 120 is a circuit for outputting various signals, and in accordance with control by the control circuit 30, driving the pixel circuits 110 arrayed in the m rows by n columns for each row. For example, the scanning line driving circuit 120 supplies scanning signals /Gwr(1), /Gwr(2), . . . , /Gwr(m−1), /Gwr (m) in order to the scanning lines 12 in the 1st, 2nd, 3rd, . . . , (m−1)-th, and m-th rows, respectively. Typically, a scanning signal supplied to the scanning line 12 in an i-th row is denoted as /Gwr(i). The scanning line driving circuit 120 outputs various control signals in addition to the scanning signals /Gwr(1) to /Gwr(m), but details will be described later.

The data signal output circuit 50 is a circuit for outputting a data signal of a voltage corresponding to luminance, toward the pixel circuit 110 located in a row selected by the scanning line driving circuit 120. Specifically, the data signal output circuit 50 includes a selection circuit group 52, a first latching circuit group 54, a second latching circuit group 56, n DA conversion circuits 500. The selection circuit group 52 includes a selection circuit 520 corresponding to each of the n columns, the first latching circuit group 54 includes a first latching circuit L1 corresponding to each of the n columns, and the second latching circuit group 56 includes a second latching circuit 12 corresponding to each of the n columns.

That is, a set of the selection circuit 520, the first latching circuit L1, the second latching circuit L2, and the LA conversion circuit 500 is provided corresponding to each column. Here, the selection circuit 520 in a j-th column instructs the first latching circuit L1 in the j-th column to select video data of the j-th row of the video data Vdata output from the control circuit 30, and the first latching circuit L1 in the j-th column latches the video data Vdata according to the instruction. The second latching circuit L2 in the j-th column outputs the video data Vdata latched by the first latching circuit L1 in the j-th column to the DA conversion circuit 500 in the j-th column in a writing period described later in accordance with control by the control circuit 30.

The DA conversion circuit 500 in the j-th column converts the 10-bit video data Vdata output from the second latching circuit L2 in the j-th column into a data signal of an analog voltage, and outputs the converted video data to the data line 14 in the j-th column as the data signal. Note that, details of the DA conversion circuit 500 will be described later.

The initialization circuit 60 is a collection of transistors 66 provided corresponding to the data lines 14 in a one-to-one manner. One end of the transistor 66 corresponding to the j-th column is coupled to a power supply line of a potential Vini, and another end of the transistor 66 is coupled to the data line 14 in the j-th column. In addition, a gate node of the transistor 62 in each column is supplied with a control signal /Gini in common by the control circuit 30.

In the figure, potentials of the data lines 14 in the 1st, 2nd, . . . , (n−1)-th, and n-th columns are denoted as Vd(1), Vd(2), . . . , Vd(n−1), Vd(n), respectively. Typically, a potential of the data line 14 in the j-th column is denoted as Vd(j).

The power supply circuit 15 generates various potentials, voltages, and the like user in the electro-optical device 10. Examples of the various potentials and voltages include power supply potentials in the scanning line driving circuit 120 an the data signal output circuit 50, potentials Vel, Vini, Vorst, Vrst, VL, VPL, VPH, and the like. Note that, a reference of a voltage zero is a ground potential Gnd (not illustrated), but other than that, the potentials and the voltages are not strictly used in the present description.

Figure 3:
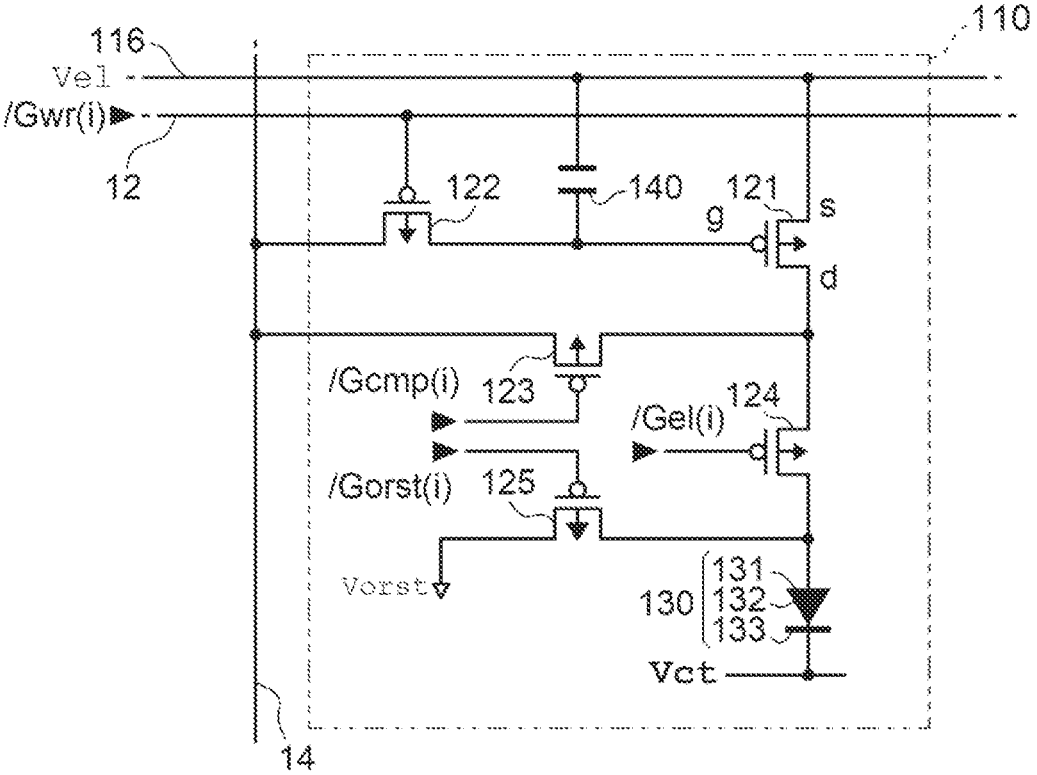
FIG. 3 is a circuit diagram illustrating a pixel circuit in the electro-optical device.

FIG. 3 is a circuit diagram illustrating the pixel circuit 110. The pixel circuits 110 arrayed in the m rows by n columns are electrically identical to each other. Thus, the pixel circuit 110 will be explained with the pixel circuit 110 located in the i-th row and the j-th column as a representative.

As illustrated, the pixel circuit 110 includes an OLED 130, p-type transistors 121 to 125, and a capacitance element 140. The transistors 121 to 125 are, for example, of an MOS-type. Note that, MOS is an abbreviation of Metal-Oxide-Semiconductor field effect transistor.

Further, in addition to the scanning signal Gwr(m), the pixel circuit 110 in the i-th row is supplied with control signals /Gel(i), /Gcmp(i), and Gorst(i) from the scanning line driving circuit 120.

The control signal /Gel(i) generally denotes control signals /Gel(1), /Gel(2), . . . , /Gel(m−1), and /Gel(m) that are supplied in order corresponding to the 1st, 2nd, . . . , (m−1)-th, and m-th rows. Similarly, the control signal /Gcmp(i) generally denotes control signals /Gcmp(1), /Gcmp(2), . . . , /Gcmp(m−1), and /Gcmp(m) that are supplied in order corresponding to the 1st, 2nd, . . . , (m−1)-th, and m-th rows. The same is true for the control signal /Gorst(i), and /Gorst(i) generally denotes control signals /Gorst(1), /Gorst(2), . . . , /Gorst(m−1), and /Gorst(m) that are supplied in order corresponding to the 1st, 2nd, . . . , (m−1)-th, m-th rows.

The OLED 130 is a display element in which a light emission function layer 132 is sandwiched between a pixel electrode 131 and a common electrode 133. The pixel electrode 131 functions as an anode, and the common electrode 133 functions as a cathode. Note that, the common electrode 133 has optical transparency. In the OLED 130, when a current flows from the anode to the cathode, holes injected from the anode and electrons injected from the cathode are recombined in the light emission function layer 132 to generate excitons and generate white light.

In a case of a color display, the generated white light resonates in an optical resonator formed of, for example, a reflective layer and a semi-reflective semi-transparent layer (not illustrated), and is emitted at a resonance wavelength set corresponding to any color of R (red), G (green), and B (blue). A color filter corresponding to the color is provided on a light emission side from the optical resonator. Thus, the emitted light from the OLED 130 is visually recognized by an observer after coloration by the optical resonator and the color filter. Note that, the optical resonator is not illustrated. In addition, when the electro-optical device 10 simply displays a monochrome image only with darkness and lightness, the above color filter is omitted.

In the transistor 121 of the pixel circuit 110 in the i-th row and the j-th column, a gate node g is coupled to a drain node of a transistor 122, and a source node s is coupled to a power supplying line 116 of a power source wiring line to which the potential Vel is supplied, and a drain node d is coupled to a source node of a transistor 123 and a source node of a transistor 124. In the capacitance element 140, one end is coupled to the gate node g of the transistor 121, and another end is coupled to the power supplying line 116. Thus, the capacitance element 140 holds a voltage between the gate node g and the source node s in the transistor 121.

Note that, the other end of the capacitance element 140 may be coupled to other power supplying lines, as far as a potential is held substantially constant, even other than the power supplying line 116.

In the present exemplary embodiment, as the capacitance element 140, for example, a so-called MOS capacitance formed by sandwiching a gate insulating layer of a transistor between a semiconductor layer of the transistor (a lower electrode), and a gate electrode layer (an upper electrode) is used. Note that, as the capacitance element 140, a parasitic capacitance of the gate node g of the transistor 121 may be used, and a so-called metal capacitance formed by sandwiching an insulating layer by mutually different conductive layers in a semi-conductor substrate may be used.

In the transistor 122 of the pixel circuit 110 in the i-th row and the j-th column, a gate node is coupled to the scanning line 12 in the i-th row, and a source node is coupled to the data line 14 in the j-th column. In the transistor 123 of the pixel circuit 110 in the i-th row and the j-th column, the control signal /Gcmp(i) is supplied to a gate node, and a drain node is coupled to the data line 14 in the j-th column. In the transistor 124 of the pixel circuit 110 in the i-th row and the j-th column, the control signal /Gel(i) is supplied to a gate node, and a drain node is coupled to the pixel electrode 131 being an anode of the OLED 130 and to a drain node of the transistor 125.

In the transistor 125 of the pixel circuit 110 in the i-th row and the j-th column, the control signal /Gorst(i) is supplied to a gate node, and a source node is coupled to a power supplying line, which is a power source wiring line to which the potential Vorst is supplied.

Note that, the potential Vorst is, for example, the ground potential Gnd, or a potential at a low level close to the ground potential Gnd. Specifically, the potential Vorst is a potential at which a current does not flow to the OLED 130 when supplied to the pixel electrode 131 in the OLED 130.

Also, the potential Vct is supplied to the common electrode 133 that functions as the cathode of the OLED 130.

Figure 4:
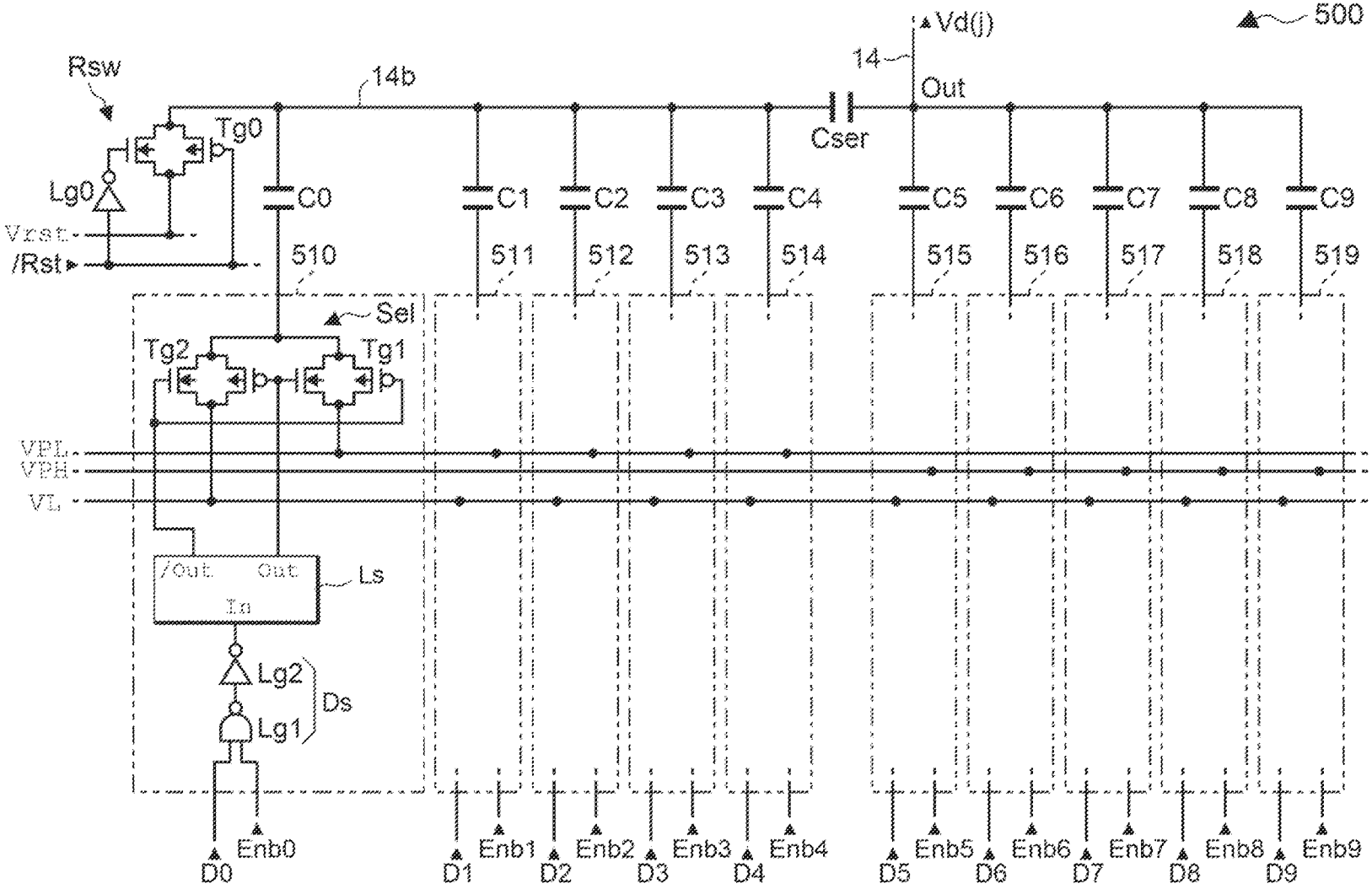
FIG. 4 is a circuit diagram illustrating the DA conversion circuit in a data signal output circuit.

FIG. 4 is a circuit diagram illustrating the DA conversion circuit 500 corresponding to the j-th column.

In the DA conversion circuit 500 in the j-th column, bits D0 to D9 are supplied from the second latching circuit L2 in the j-th column. Additionally, to the DA conversion circuit 500 in the j-th column, control signals Enb0 to Enb9, and a control signal /Rst are supplied from the control circuit 30, and the potentials Vrst, VL, VPL, and VPH are supplied from the power supply circuit 15.

Note that, in FIG. 4, the potentials VPL and VPH are separated, but in the first exemplary embodiment, description will be given provided that VPL=VPH for convenience. Also, the potentials VL, VPL, and VPH are in a relationship of VL<VPL=VPH in the first exemplary embodiment.

The bits D0 to D9 are ten bits of the video data Vdata output from the second latching circuit L2 in the j-th column, and are data to be converted by the DA conversion circuit 500. Of the ten bits, a lowest bit is D0, and weight increases in order of D1, D2, . . . , from the bit D0, and a highest bit is D9.

The control signals Enb0 to Enb9 are signals that sequentially specify taking-in timing of bits D0 to D9, respectively. The control signal /Rst is a signal for resetting the capacitance element.

As illustrated in the figure, the DA conversion circuit 500 includes capacitance elements C0 to C9, Cser, a switch Rsw, and selection circuits 510 to 519. The capacitance elements C0 to C9 and the selection circuits 510 to 519 are paired as follows so as to correspond to the respective bits. Specifically, the selection circuit 510 and the capacitance element C0 form a pair corresponding to the bit D0, the selection circuit 511 and the capacitance element C1 form a pair corresponding to the bit D1, and hereinafter, in the same manner, the selection circuit 519 and the capacitance element C9 form a pair corresponding to the bit D9.

Note that, in the present exemplary embodiment, among the ten bits of video data Vdata, the bits D5 to D9 are an example of higher bits, and the bits D0 to D4 are an example of lower bits. Further, the capacitance elements C0 to C9 are examples of the capacitance element unit.

The selection circuits 510 to 514 corresponding to the lower bits select the potential VL or VPL, and supply the selected potential to one end of a corresponding capacitance element. Also, the selection circuits 515 to 519 corresponding to the higher bits select the potential VL or VPH, and supply the selected potential to one end of a corresponding capacitance element.

For example, the selection circuit 510 corresponding to the bit D0 takes in the bit D0 at timing specified by the control signal Enb0, selects the potential VL or VPL according to a logical level of the bit D0 taken in, and supplies the selected potential to one end of the capacitance element C0. Further, for example, the selection circuit 516 corresponding to the bit D6 takes in the bit D6 at timing specified by the control signal Enb6, selects the potential VL or VPH according to a logical level of the bit D6 taken in, and supplies the selected potential to one end of the capacitance element C6.

Capacitance values of the respective capacitance elements C0 to C9 have the following ratios in the present exemplary embodiment. Specifically, when the capacitance value of the capacitance element C0 is "1", then the capacitance values of the respective capacitance elements C2, C3, C4, C5, C6, C7, C8, and C9 are, in this order, "2", "4", "8", "16", "1", "2", "4", "8", and "16".

Note that, weights of the respective bits D0 to D9 are, when considered as a total of ten bits, "1", "2", "4", "8", "16", "32", "64", "128", "256", and "512", in order. Therefore, the capacitance values of the respective capacitance elements C0 to C9 do not match the weight. However, when the bits D0 to D9 are divided into the lower bits D0 to D4, the higher bits D5 to D9, the bit D5 is defined as a lowest bit of the bits D5 to D9, and the weight is regarded as "1", the weights of the respective bits D5 to D9 are "1", "2", "4", "8", and "16" in order. In the present description, since it is also necessary to consider the case where the bits D0 to D9 are divided into the lower bits D0 to D4, and the higher bits D5 to D9, it is expressed that the capacitance elements C0 to C9 have the respective capacitance values corresponding to the weights of the bits D0 to D9 in order.

Further, the capacitance element Cser is an example of a coupling capacitance, and a capacitance value of the capacitance element Cser in the first exemplary embodiment is "1". Note that, for the capacitance values of the respective capacitance elements C0 to C9, and CSer, errors to some extent are tolerated as long as linearity described below is maintained.

In the present exemplary embodiment, the MOS capacitance is used as the capacitance element 140 in the pixel circuit 110, and thus the MOS capacitance may also be used for the capacitance elements C0 to C9, and Cser, but a metal capacitance may be used.

Another ends of the respective capacitance elements C0 to C4, of the capacitance elements C0 to C9, corresponding to the lower five bits are electrically coupled to one end of the capacitance element Cser. For convenience, a coupling line between the other ends of the respective capacitance elements C0 to C4 and the one end of the capacitance element Cser is denoted as a relay line 14*b*. Additionally, another ends of the respective capacitance elements C5 to C9, of the capacitance elements C0 to C9, corresponding to the higher five bits are electrically coupled to the data line 14, which is an output end Out of the DA conversion circuit 500, and another end of the capacitance element Cser.

Note that, in the present description, "electrically coupled" means a direct or indirect coupling or joint among two or more element and includes, for example, coupling among two or more elements in a semiconductor substrate, not directly, but via a different wiring layer and a contact hole.

The switch Rsw is brought into an on state or an off state in accordance with the control signal /Rst between a power supplying line of the potential Vrst and the relay line 14*b*. Specifically, the switch Rsw is brought into the on state when the control signal /Rst is at an L level, and is brought into the off state when the control signal /Rst is at an H level.

In the present description, the "on state" of a switch or a transistor means that both end of the switch, or a source node and a drain node in the transistor are electrically closed to be in a low impedance state. In addition, the "off state" of a switch or a transistor means that both end of the switch, or a source node and a drain node are electrically opened to be in a high impedance state.

The switch Rsw may be configured with a NOT circuit Lg0 that outputs a negative signal of the control signal /Rst, and a transmission gate Tg0. The transmission gate Tg0 is an analog switch in which an n-type transistor in which a negative signal by the NOT circuit Lg0 is supplied to a gate node, and a p-type transistor in which the control signal /Rst is supplied to a gate node, are combined.

The selection circuit 510 paired with the capacitance element C0 includes an AND circuit Ds, a level shifter Ls, and a selector Sel. Of these, the AND circuit Ds outputs a logical product signal of the bit D0 of the video data Vdata output from the second latching circuit L2 in the j-th column, and the control signal Enb0 supplied from the control circuit 30. The AND circuit Ds is actually configured with a NAND circuit Lg1 that outputs a negative logical product signal of the bit D0 and the control signal Enb0, and a NOT circuit Lg2 that outputs a negative signal of the negative logical product signal.

The level shifter Ls converts logical amplitude of the logical product signal output by the AND circuit Ds to output a forward rotation signal in which a logical level of the logical product signal is maintained from the output end Out, and outputs a reverse rotation signal in which the logical level of the logical product signal is reversed from an output end /Out.

The selector Sel in the selection circuit 510 selects the potential VPL, when the forward rotation signal output from the level shifter Ls is at the H level, and the reverse rotation signal is at the L level. In other words, the selector Sel selects the potential VPL, when the bit D0 is "1", and the control signal Enb0 is at the H level.

In addition, the selector Sel selects the potential VL, when the forward rotation signal output from the level shifter Ls is at the L level, and the reverse rotation signal is at the H level. In other words, the selector Sel selects the potential VL, when the bit D0 is "0", or the control signal Enb0 is at the L level.

The selector Sel is actually configured with a transmission gate Tg1 provided between a power supplying line of the potential VPL, and the one end of the capacitance element C0, and a transmission gate Tg2 provided between a power supplying line of the potential VL and the one end of the capacitance element C0.

In this configuration, when the forward rotation signal output from the level shifter Ls is at the H level, and the reverse rotation signal is at the L level, the transmission gate Tg1 is brought into the on state, the transmission gate Tg2 is brought into the off state, the forward rotation signal output from the level shifter Ls is at the L level, and the reverse rotation signal is at the H level, the transmission gate Tg1 is brought into the off state, and the transmission gate Tg2 is brought into the on state.

Although the selection circuit 510 paired with the capacitance element C0 has been described here, the other selection circuits 511 to 514 corresponding to the lower bits each have a similar configuration to that of the selection circuit 510 except that the bits D1 to D4 of an input signal and the control signals Enb1 to Enb4 are different.

In addition, the selection circuits 515 to 519 corresponding to the higher bits each have a similar configuration to that of the selection circuits 510 to 514, except that the potential VPH is selected when the forward rotation signal output from the level shifter Ls is at the H level, and the reverse rotation signal is at the L level, and that the bits D5 to D9 of an input signal and the control signals Enb5 to Enb9 are different.

Figure 5:
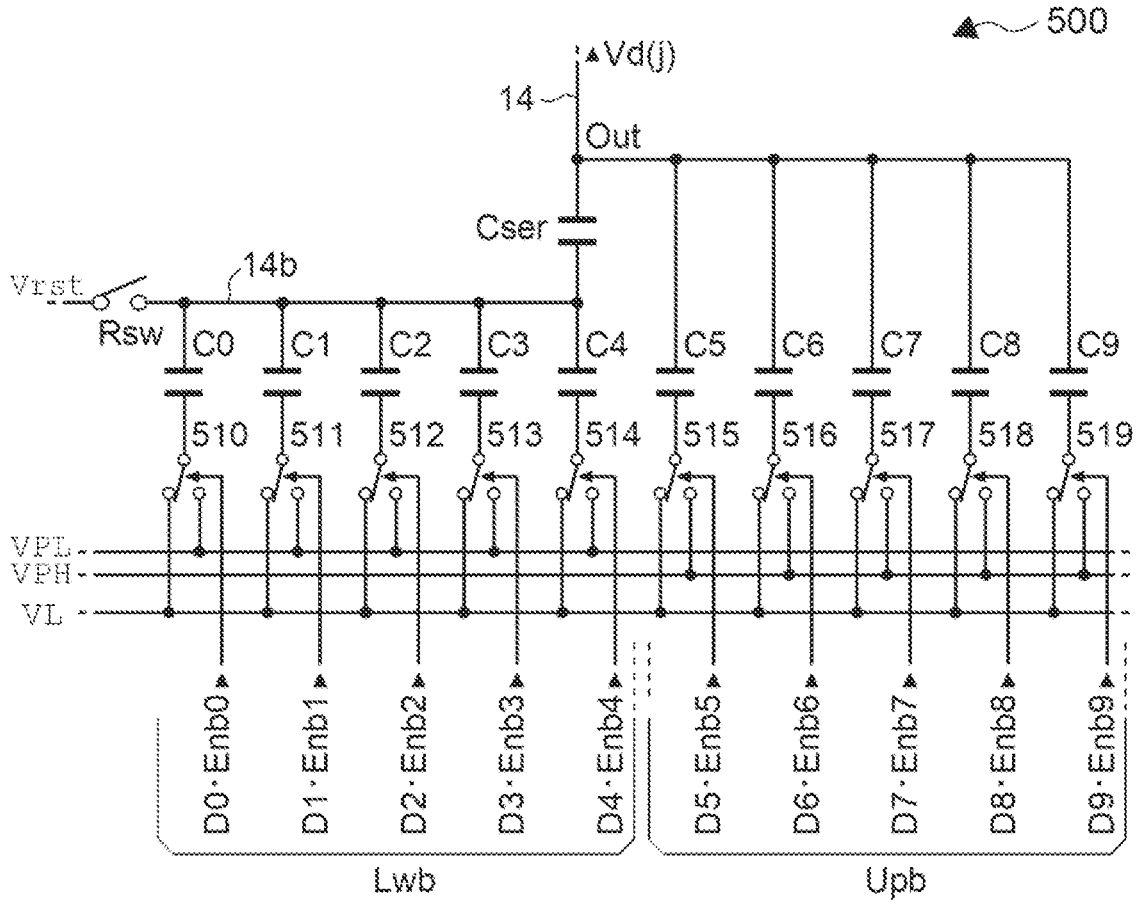
FIG. 5 is a diagram illustrating an equivalent circuit of the DA conversion circuit.

FIG. 5 is a diagram illustrating an equivalent circuit in the DA conversion circuit 500 in the j-th column.

The selection circuit 510 is denoted as a single pole double throw switch that selects the potential VL, when a logical product signal of the bit D0 and control signal Enb0 (D0·Enb0) is at the L level, and selects the potential VPL, when the logical product signal is at the H level. Each of the selection circuits 511 to 514 is also denoted as a single pole double throw switch similar to the selection circuit 510.

The selection circuit 515 is denoted as a single pole double throw switch that selects the potential VL, when a logical product signal of the bit D5 and control signal Enb5 (D5·Enb5) is at the L level, and selects the potential VPH, when the logical product signal is at the H level. Each of the selection circuits 516 to 519 is also denoted as a single pole double throw switch similar to the selection circuit 515.

In FIG. 4 and FIG. 5, the DA conversion circuit 500 in the j-th column has been described, but the DA conversion circuits 500 corresponding to the other columns each have a similar configuration. Note that, FIG. 4 and FIG. 5 each illustrate only an electrical configuration, and do not illustrate an actual position or array of an element configuring the DA conversion circuit 500.

Operation of the DA conversion circuit 500 is divided into a reset period and an output period. Note that, the reset period of the DA conversion circuit 500 includes an initialization period (a) and a compensation period (b) of an operation period of the electro-optical device 10 described later, and the output period of the DA conversion circuit 500 is a writing period (c) of the operation period of the electro-optical device 10.

In the DA conversion circuit 500, in the reset period, the switch Rsw is brought into the on state, and the selection circuits 510 to 519 select the potential VL. In addition, at an end of the reset period, the data line 14, which is the output end Out, is at approximately the same potential as the potential Vrst, specifically a threshold equivalent voltage in the electro-optical device 10 described below, due to an element not illustrated in FIG. 5. Thus, a charge corresponding to a capacitance value is accumulated in each of the capacitance elements C0 to C9.

In the output period in the DA conversion circuit 500, the selection circuits 510 to 514 each select the potential VL when a corresponding logical product signal is at the L level, and each select the potential VPL when the corresponding logical product signal is at the H level. In addition, in the output period, the selection circuits 515 to 519 each select the potential VL when a corresponding logical product signal is at the L level, and each select the potential VPH when the corresponding logical product signal is at the H level. As described below, at an end of the output period, the control signals Enb0 to Enb9 are at the H level, and thus the selection circuits 510 to 519 select the potential VL or VPL (or VPH) in order in accordance with the logical levels of bits D0 to D9, respectively.

That is, in the output period, the voltages at one ends of the capacitance elements C0 to C9 are either changed (increased) or maintained in accordance with the bits D0 to D9, respectively. Therefore, of the capacitance elements C0 to C9, at another ends of the capacitance elements C0 to C9 where the voltages at the one ends changes, respectively, discharge of accumulated charges increases a voltage at the end of the reset period, by a voltage in accordance with a capacitance value.

At the other end of each of the capacitance elements C5 to C9 corresponding to the higher bits, a voltage of the data line 14 is increased in accordance with a capacitance value. In contrast, the other end of each of the capacitance elements C0 to C4 corresponding to the lower bits, is coupled to the data line 14 via the capacitance element Cser, and thus a voltage change of the relay line 14*b*, which is the other end of each of the capacitance elements C0 to C4, is compressed by a ratio defined by the capacitance elements C0 to C4 and Cser, and changes a voltage of the data line 14. When the ratio is denoted as a compression ratio k, the compression ratio k is represented by Equation (1) below.

$$k=Cser/(Cser+C0+C1+C2+C3+C4) \quad (1)$$

Note that, in the first exemplary embodiment, the compression ratio k is 1/32 (=1/(1+1+2+4+8+16).

Here, in FIG. 5, a circuit including the capacitance elements C5 to C9 and the selection circuits 515 to 519 is referred to as a first DA conversion circuit unit Upb. The first DA conversion circuit unit Upb outputs a voltage corresponding to the bits D5 to D9 to the data line 14.

Similarly, a circuit including the capacitance elements C0 to C4 and the selection circuits 510 to 514 is referred to as a second DA conversion circuit unit Lwb. The second DA conversion circuit unit Lwb outputs a voltage corresponding to the bits D0 to D4 to the relay line 14*b*. However, a voltage change of the relay line 14*b* is compressed to 1/32 of the compression ratio k, and is output to the data line 14.

Thus, even when the bits D0 to D4 are the same as the bits D5 to D9 in this order, the voltage change of the data line 14 by the second DA conversion circuit unit Lwb is 1/32 of the voltage change of the data line 14 by the first DA conversion circuit unit Upb.

Thus, the DA conversion circuit 500 will change the data line 14 from a voltage at the end of the reset period by a voltage corresponding to the weights of the respective bits D0 to D9.

Figure 6:
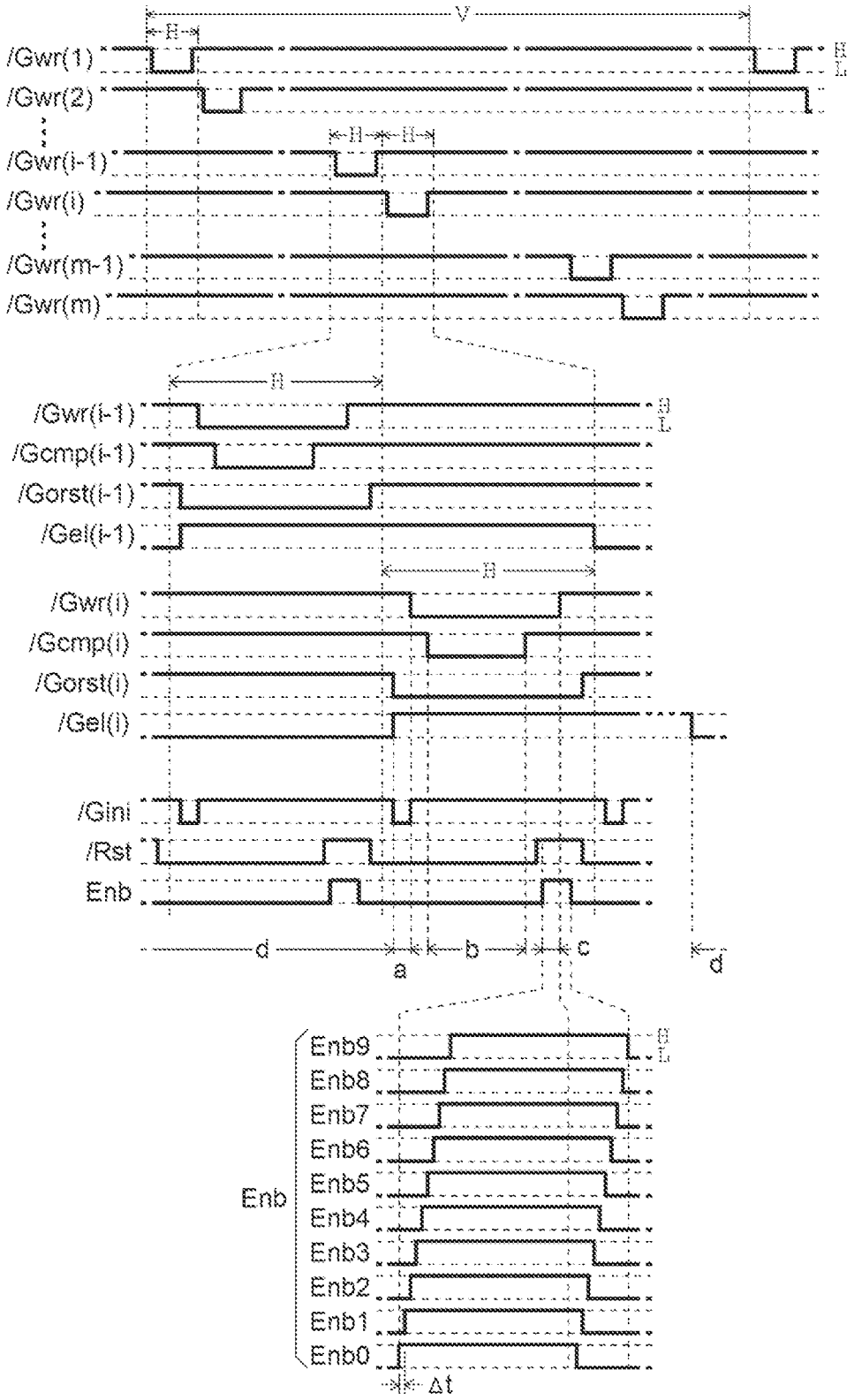
FIG. 6 is a timing chart illustrating operation of the electro-optical device.

FIG. 6 is a timing chart for explaining operation of the electro-optical device 10.

In the electro-optical device 10, the scanning lines 12 in the m rows are scanned one by one, in an order of the 1st, 2nd, 3rd, . . . , m-th row in a period of a frame (V). Specifically, as illustrated in the figure, the scanning signals /Gwr(1), /Gwr(2), . . . , /Gwr(m−1), /Gwr(m), and /Gwr(m), are sequentially and exclusively set to the L level, in each horizontal scanning period (H) by the scanning line driving circuit 120.

Note that, in the present exemplary embodiment, periods in which the scanning signals adjacent to each other, among the scanning signals /Gwr(1) to /Gwr(m), are set to the L level, respectively, are temporally isolated. Specifically, after a scanning signal /Gwr(i−1) changes from the L level to the H level, the next scanning signal /Gwr(i) is set to the L level after a period. This period corresponds to a horizontal blanking period.

In the present description, the period of one frame (V) refers to a period required to display a single frame of an image specified by the video data Vid. When a length of the one frame (V) is equal to a vertical synchronization period, for example, when a frequency of a vertical synchronization signal included in the synchronization signal Sync is 60 Hz, the length of the one frame (V) is 16.7 milliseconds corresponding to one cycle of the vertical synchronization signal. Further, the horizontal scanning period (H) is an interval of time during which the scanning signals /Gwr(1) to /Gwr(m) are sequentially set to the L level, but in the figure for convenience, start timing of the horizontal scanning period (H) is set almost at a center of the horizontal blanking period.

One horizontal scanning period (H) in the electro-optical device 10 is mainly divided into three periods of the initialization period (a), the compensation period (b), and the writing period (c). Further, as operation of the pixel circuit 110, a light emission period (d) is further added, separately from the three periods described above.

In each horizontal scanning period (H), in the initialization period (a), the control signal /Gini is at the L level, the control signal /Rst is at the L level, and the control signal Enb is at the L level. Note that, the control signal Enb is a signal collectively referred to as the control signals Enb0 to Enb9. The control signals Enb0 to Enb9 have respective phases that sequentially shift in the writing period (c) as described later, but have the same wave form in the other periods, thus are collectively referred to as the control signal Enb in this manner.

In the compensation period (b), the control signal /Gini is at the H level, and the control signals /Rst and Enb are kept to be at the L level.

In the writing period (c), the control signal /Gini is kept to be at the H level, and the control signals /Rst and Enb are set to the H level.

Operation in the horizontal scanning period (H) will be described using the i-th row as an example. In addition, the pixel circuit 110 will be described using the pixel circuit 110 in the i-th row and the j-th column as an example.

In the horizontal scanning period (H) of the i-th row, the initialization period (a) of the i-th row starts before the scanning signal /Gwr(i) is set to the L level. The initialization period (a) is a period for resetting a voltage or a charge remaining in each unit in the horizontal scanning period (H) of an (i−1)-th row.

Figure 7:
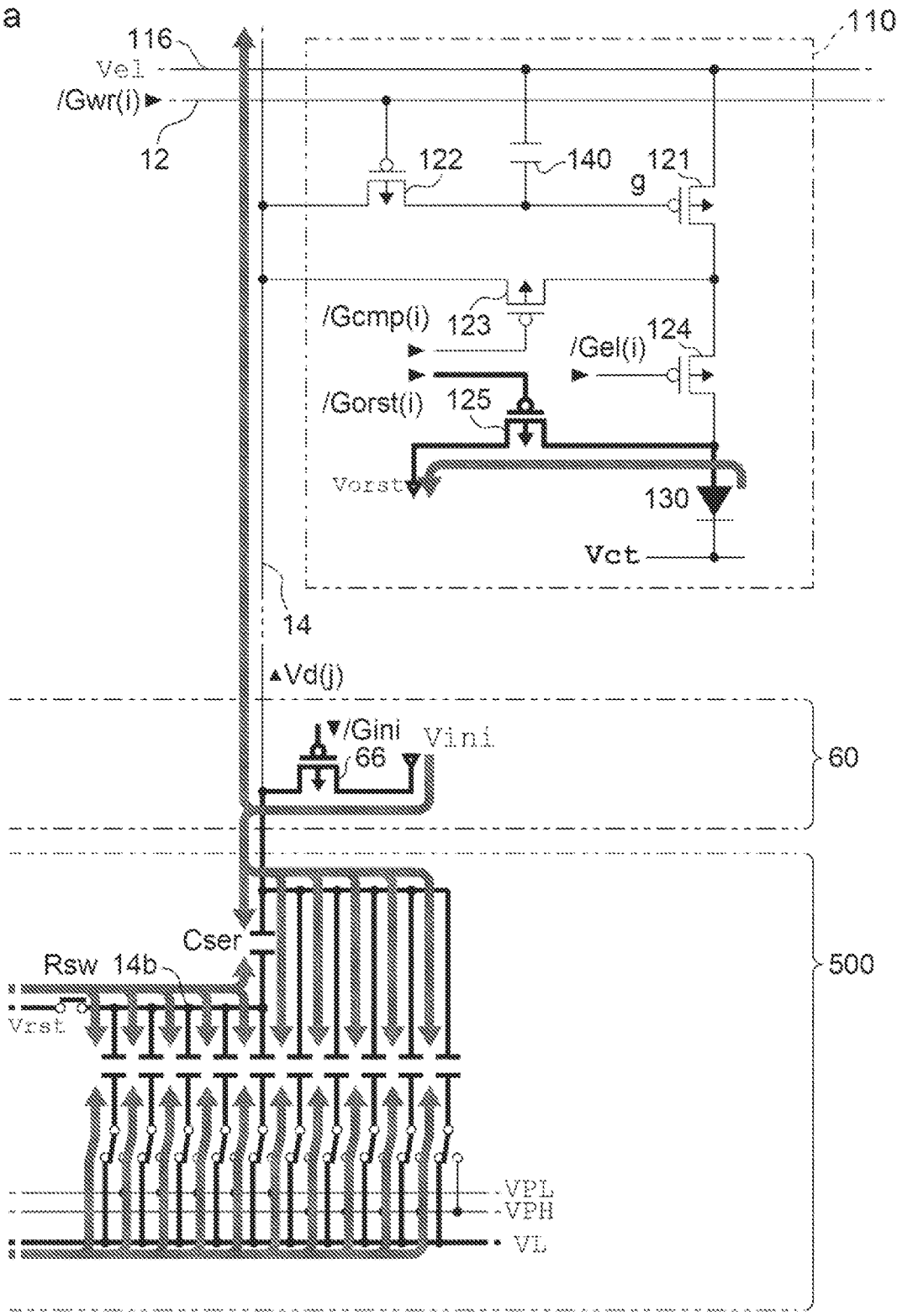
FIG. 7 is a diagram for explaining operation of the electro-optical device.

FIG. 7 is a diagram for explaining operation of the pixel circuit 110 in the i-th row and the j-th column, and the DA conversion circuit 500 corresponding to the data line 14 in the j-th column in the initialization period (a) of the i-th row.

In the initialization period (a), the transistor 66 is brought into the on state when the control signal /Gini is set to the L level, and thus the data line 14 is initialized to the potential Vini. In addition, in the initialization period (a), the switch Rsw is brought into the on state when the control signal /Rst is set to the L level, and thus the relay line 14*b* is set to the potential Vrst. In the initialization period (a), since the control signal Enb is at the L level, regardless of the respective logic levels of the bits D0 to D9 output from the second latching circuit L2, the logical product signal of the AND circuit Ds of each of the selection circuits 510 to 519 set to the L level. Thus, the selection circuits 510 to 519 each select the potential VL.

Thus, in the initialization period (a), one end of each of the capacitance elements C0 to C9 is set to the potential VL, one end of the capacitance element Cser and another end of each of the capacitance elements C0 to C4 is set to the potential Vrst, and another end of the capacitance element Cser and another end of each of the capacitance elements C5 to C9 are set to the potential Vini via the data line 14. In this manner, in the initialization period (a), a charge stored in each of the capacitance elements C0 to C9 and Cser is initialized along with the initialization of the data line 14.

Additionally, in the initialization period (a) of the i-th row, the control signal /Gel(i) is set to the H level, and the control signal /Gorst(i) is set to the L level. Thus, in the pixel circuit 110 in the i-th row, the transistor 124 is brought into the off state, and the transistor 125 is brought into the on state, so the pixel electrode 131, which is the anode of the OLED 130, is set to the potential Vorst. Thus, the OLED 130 is turned off, and the pixel electrode 131 is reset to the potential Vorst.

Note that, the reason why the pixel electrode 131 is reset is to eliminate an effect of a voltage applied during an immediately preceding light emission period, because a capacitance parasitizes in the OLED 130.

After the initialization period (a) ends, the compensation period (b) follows. The compensation period (b) is a period for, in the n pixel circuits 110 located in the i-th row, causing a voltage of the gate node g of each transistor 121 to converge at a voltage corresponding to a threshold value of the transistor 121.

Figure 8:
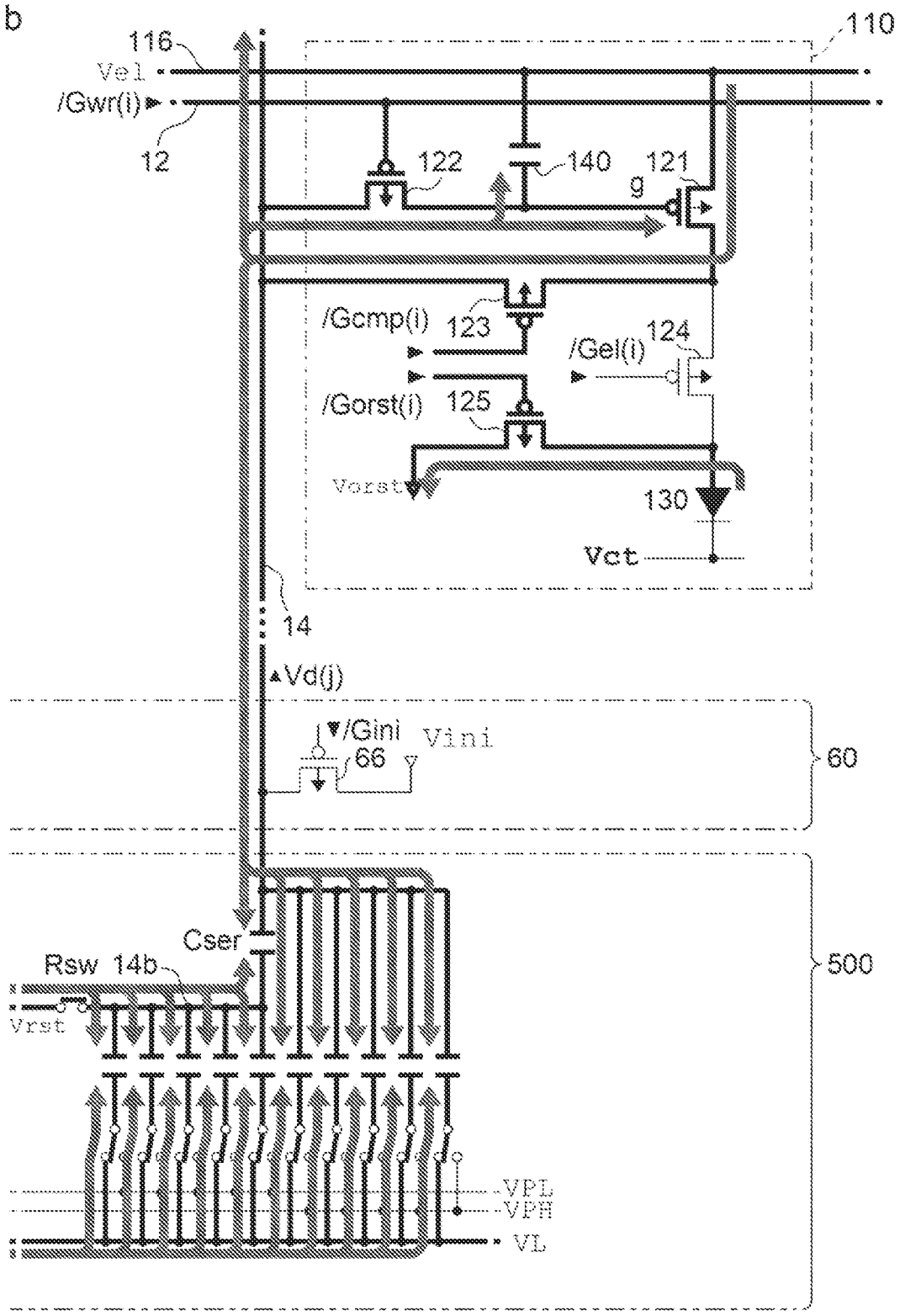
FIG. 8 is a diagram for explaining operation of the electro-optical device.

FIG. 8 is a diagram for explaining operation of the pixel circuit 110 in the i-th row and the j-th column, and the DA conversion circuit 500 corresponding to the data line 14 in the j-th column in the compensation period (b) of the i-th row.

In the compensation period (b), the control signal /Gini is set to the H level so that the transistor 66 is brought into the off state. Additionally, in the compensation period (b), the control signal /Rst is at the L level, the on state of the switch Rsw is maintained, and the control signal Enb is at the L level, thus the selection of the potential VL by the selection circuits 510 to 519 is maintained.

Additionally, in the compensation period ((b) of the i-th row, the scanning signal /Gwr(i) is set to the L level, and the control signal /Gcmp(i) is set to the L level in the state of the L level. Thus, in the pixel circuit 110 in the i-th row, the transistor 122 is in the on state, and the transistor 123 is brought into the on state. Thus, since the transistor 121 is brought into a diode-coupled state, a voltage between the gate node and the source node in the transistor 121 converges at a voltage corresponding to a threshold value of the transistor 121 (threshold value equivalent voltage).

In the compensation period (b) of the i-th row, since the transistors 122 and 123 in the pixel circuit 110 are in the on state, the other end of the capacitance element Cser and the other end of each of the capacitance elements C5 to C9 also converge at the threshold value equivalent voltage of the transistor 121 via the data line 14.

Note that, in the compensation period (b), the one ends of the capacitance elements C0 to C9 are maintained at the potential VL by the selection circuits 510 to 519, respectively, and the other end of the capacitance element Cser and the other ends of the respective capacitance elements C0 to C4 are maintained at the potential Vrst by the on state of the switch Rsw. In addition, in the compensation period (b) of the i-th row, in the pixel circuit 110 in the i-th row, the off state of the transistor 124 and the on state of the transistor 125 continue from the initialization period (a).

The potential Vrst is set to an average threshold value equivalent voltage in the transistor 121 in each column. Therefore, at an end of the compensation period (b), a voltage applied to both ends of each of the capacitance elements C0 to C4 and a voltage applied to both ends of each of the capacitance elements C5 to C9 are approximately the same. Therefore, in the compensation period (b), it may be considered that a charge corresponding to a capacitance value is accumulated in each of the capacitance element C0 to C9.

After the compensation period (b) ends, the writing period (c) follows. The writing period (c) is a period for applying a voltage corresponding to luminance to the gate node g of each transistor 121 in the pixel circuit 110 in the n-th column located in the i-th row.

Figure 9:
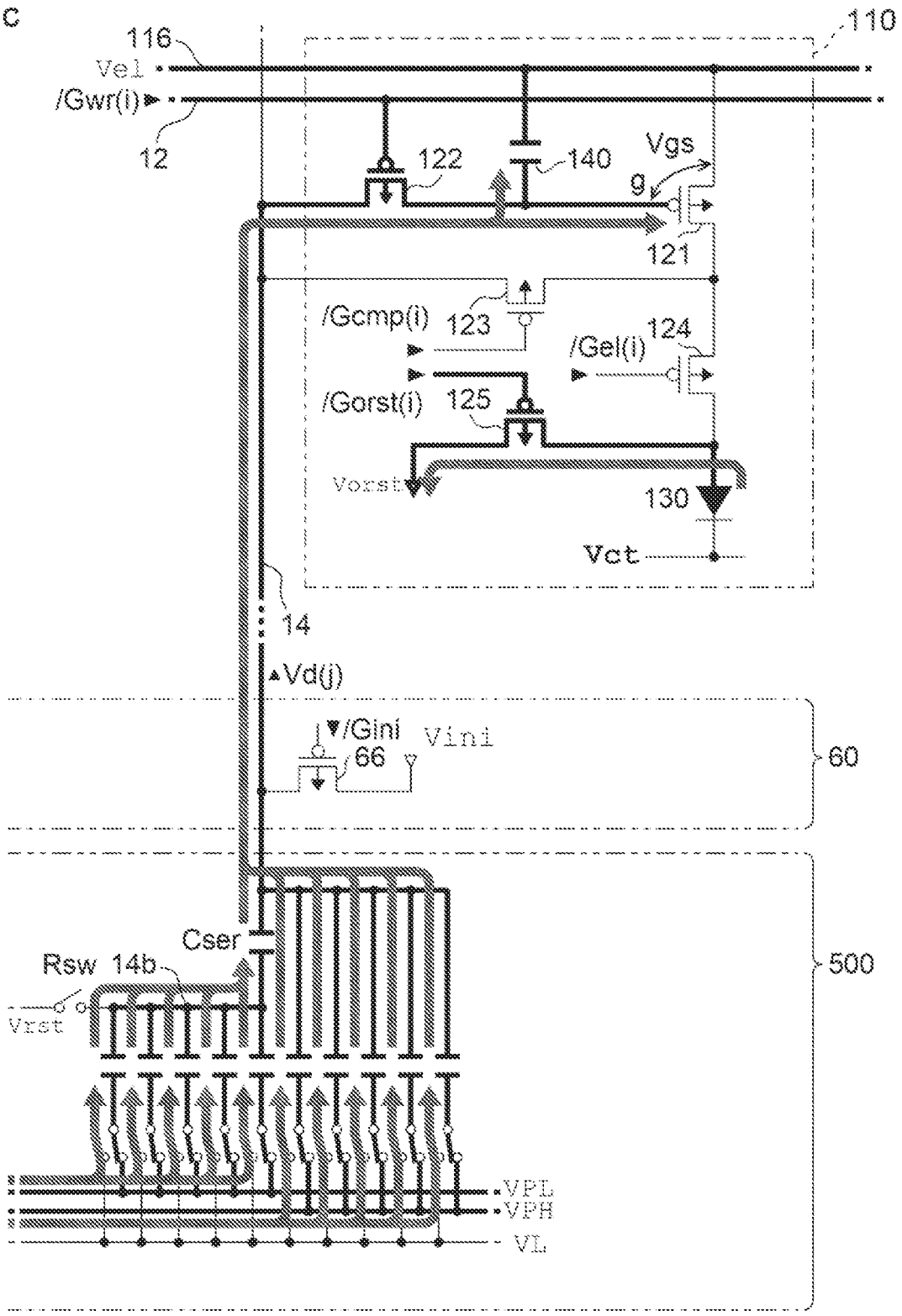
FIG. 9 is a diagram for explaining operation of the electro-optical device.

FIG. 9 is a diagram for explaining operation of the pixel circuit 110 in the i-th row and the j-th column, and the DA conversion circuit 500 corresponding to the data line 14 in the j-th column in the writing period (c) of the i-th row.

In the writing period (c), the control signal /Rst is set to the H level, and thus the switch Rsw is brought into the off state. In addition, in the writing period (c), after the control signal Enb0 is set to the H level as illustrated in FIG. 6, the control signals Enb1 to Enb9 are sequentially delayed by a time ΔT and set to the H level. In addition, when the control signal Enb0 changes from the H level to the L level, the control signals Enb1 to Enb9 are sequentially delayed by the time ΔT and set to the L level. Note that, the writing period (c) ends when all of the control signals Enb0 to Enb9 are at the H level, and before the control signal Enb0 changes from the H level to the L level.

Of video data output from the second latching circuit L2 in the j-th column, a period in which the bit D0 is input to the level shifter Ls of the selection circuit 510 is limited by the AND circuit Ds to a period in which the control signal Enb0 is at the H level. Similarly, a period in which the bits D1 to D9 are sequentially input to the level shifters Ls in the selection circuits 511 to 519, respectively, is limited to a period in which the control signals Enb1 to Enb9 are sequentially set to the H level by the AND circuits Ds. Thus, the bits D0 to D9 are taken in the selection circuits 510 to 519, respectively, not simultaneously, but are sequentially delayed by the time ΔT.

Of the selection circuits 510 to 514, a selection circuit in which a bit input to the level shifter Ls is "1" selects the potential VPL, and the selection circuit in which the bit is "0" selects the potential VL. Further, of the selection circuits 515 to 519, a selection circuit in which a bit input to the level shifter Ls is "1" selects the potential VPH, and a selection circuit in which the bit is "0" selects the potential VL.

In the writing period (c), a voltage of one end of a capacitance element, of the capacitance elements C0 to C9, corresponding to a bit of "0" input to the level shifter Ls does not change since the compensation period (b), and thus the capacitance element does not contribute to a voltage rise of the data line 14.

At one end of the capacitance element, of the capacitance elements C5 to C9 corresponding to the higher five bits, corresponding to a bit of "1" input to the level shifter Ls, the potential VL changes to the potential VPH in the writing period (c). Thus, the capacitance element, of the capacitance elements C5 to C9, corresponding to the bit of "1" causes a voltage of the data line 14 to rise from the threshold equivalent voltage in the compensation period (b), in accordance with amount corresponding to a weight of the capacitance value.

At one end of the capacitance element, of the capacitance elements C0 to C4 corresponding to the lower five bits, corresponding to a bit of "1" input to the level shifter Ls, the potential VL changes to the potential VPL in the writing period (c). However, unlike the other ends of each of the capacitance elements C5 to C9, the capacitance element Cser is interposed between the other end of each of the capacitance elements C0 to C4 and the data line 14. Thus, an amount of change from the potential VL to the potential VPL at the one end of the capacitance element, of the capacitance elements C0 to C4, corresponding to the bit of "1" is compressed with the compression ratio k to raise the voltage of the data line 14.

In this manner, in the writing period (c), the DA conversion circuit 500 in the j-th column raises the voltage of the data line 14 in the j-th column from the threshold equivalent voltage by a voltage corresponding to the bit D0 to D9 of the video data Vdata in the i-th row and the j-th column, that is, a voltage that specifies luminance of the OLED in the i-th row and the j-th column.

In the present exemplary embodiment, in the writing period (c), the periods in which the control signals Enb0 to Enb9 are set to the H level, respectively, are sequentially delayed by the time ΔT. The reason for that is that when the control signals Enb0 to Enb9 are collectively set to the H level, switching from the potential VL to VPL or VPH occurs at the same time, and a spike variation associated with the voltage switching increases, is propagated to each part, in particular, is propagated to the data line 14, and reduces DA conversion accuracy. Therefore, in the present exemplary embodiment, the phases of the respective control signals Enb0 to Enb9 are shifted sequentially so that the switching from the potential VL to VPL or VPH does not occur simultaneously.

According to the present exemplary embodiment, an effect of a voltage variation due to the spike in accordance with the voltage switching is reduced, and thus a decrease in the DA conversion accuracy is suppressed. Note that, an order in which the control signals Enb0 to Enb9 are set to the H level need not be an order of the control signals Enb0 to Enb9.

In the writing period (c) of the i-th row, in the pixel circuit 110 in the i-th row and the j-th column, the transistor 122 is kept in the on state, the transistor 123 is brought into the off state, and thus a potential Vd(j) output from the DA conversion circuit 500 in the j-th column is supplied via the data line 14 to the gate node g of the transistor 121.

In addition, in the writing period (c) of the i-th row, in the pixel circuit 110 in the i-th row, the off state of the transistor 124 and the on state of the transistor 125 still continue.

When the scanning signal /Gwr(i) changes to the H level, the writing period (c) of the i-th row ends. When the scanning signal /Gwr(i) is set to the H level, the transistor 122 is brought into the off state in the pixel circuit 110 in the i-th row and the j-th column, but a voltage of a difference between the potential Vd(j) of the gate node g and the potential Vel is retained in the capacitance element 140. Note that, in FIG. 9, the voltage of the difference between the potential Vd(j) of the gate node g and the potential Vel is denoted as Vgs. Furthermore, the figure illustrates a case in which all of the bits D0 to D9 of the video data output from the second latching circuit L2 are "1".

After the writing period (c) ends, the light emission period (d) follows. The light emission period (d) is a period for causing a current corresponding to the voltage Vgs retained in the writing period (c) to flow through the OLED 130 to emit light.

Figure 10:
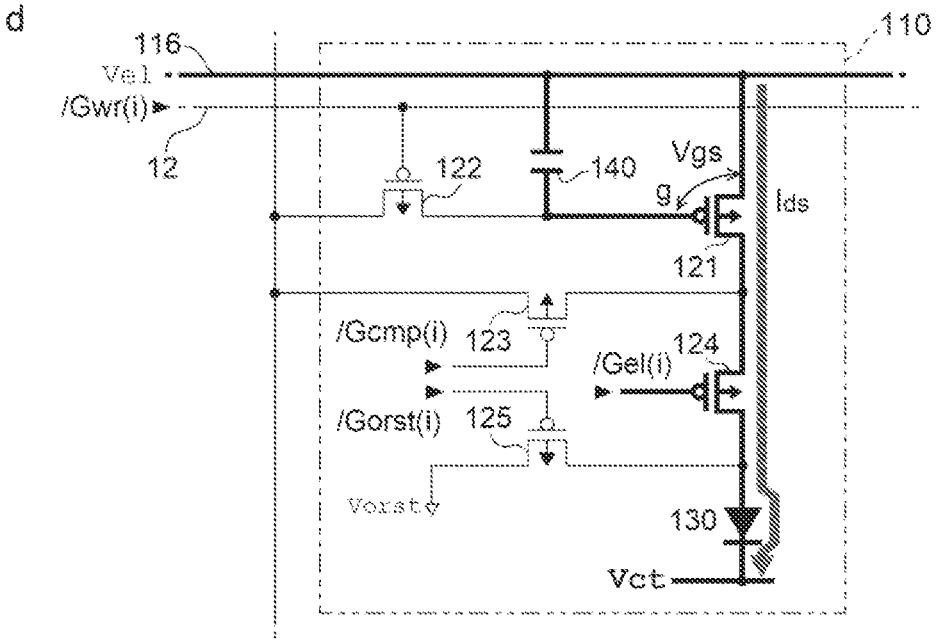
FIG. 10 is a diagram for explaining operation of the electro-optical device.

FIG. 10 is a diagram for explaining operation of the pixel circuit 110 in the i-th row and the j-th columns in the light emission period (d) of the i-th row.

Before the light emission period (d) of the i-th row, the control signal /Gorst(i) is set to the H level, and thus the transistor 125 is brought into the off state. In addition, when the light emission period (d) of the i-th row is reached, the control signal /Gel(i) is reversed to the L level, and thus the transistor 124 is brought into the on state. Thus, a current Ids in accordance with the voltage Vgs retained by the capacitance element 140 is caused to flow through the OLED 130 by the transistor 121. Thus, the OLED 130 is brought into an optical state in accordance with the current Ids, that is, a state of emitting light with luminance in accordance with the current Ids.

Note that, FIG. 10 is an example in which the light emission period (d) is continuous after the end of selection of the scanning line 12 in the i-th row, but the period in which the control signal /Gel(i) is set to the L level may be intermittent, or may be adjusted in accordance with luminance adjustment. Furthermore, the level of the control signal /Gel(i) in the light emission period (d) may be raised from the L level in the compensation period (b). That is, an intermediate level between the H level and the L level may be used for the level of the control signal /Gel(i) in the light emission period (d).

In addition, in the light emission period (d) of the i-th row, the DA conversion circuit 500 corresponding to the j-th column performs the operation of the horizontal scanning period (H) of the rows other than the i-th row, and thus the DA conversion circuit 500 is omitted in FIG. 10.

In FIG. 7 to FIG. 9, in the horizontal scanning period (H) of the i-th row, the DA conversion circuit 500 corresponding to the j-th column and the pixel circuit 110 in the i-th row and the j-th column have been focused, but similar operation is performed for the DA conversion circuit 500 and the pixel circuit 110 corresponding to the other columns other than the j-th column.

Also, in FIG. 7 to FIG. 9, the horizontal scanning period (H) of the i-th row has been focused, while the operation of the horizontal scanning period (H) has been described, but similar operation is performed sequentially for the horizontal scanning periods (H) of the 1st, 2nd, 3rd, . . . , m-th rows.

In the pixel circuit 110, the voltage Vgs in the writing period (c) and the light emission period (d) is a voltage that is changed in accordance with a gray scale level of the pixel circuit 110 from a threshold voltage in the compensation period (b). Since similar operation is performed for the other pixel circuits 110, in the first exemplary embodiment, a current corresponding to a gray scale level flows through the OLED 130 with a threshold value of the transistor 121 being compensated for, for all of the pixel circuits 110 in the m rows by n columns. Thus, in the present exemplary embodiment, a variation in luminance is reduced, as a result, high-quality display is possible.

Figure 11:
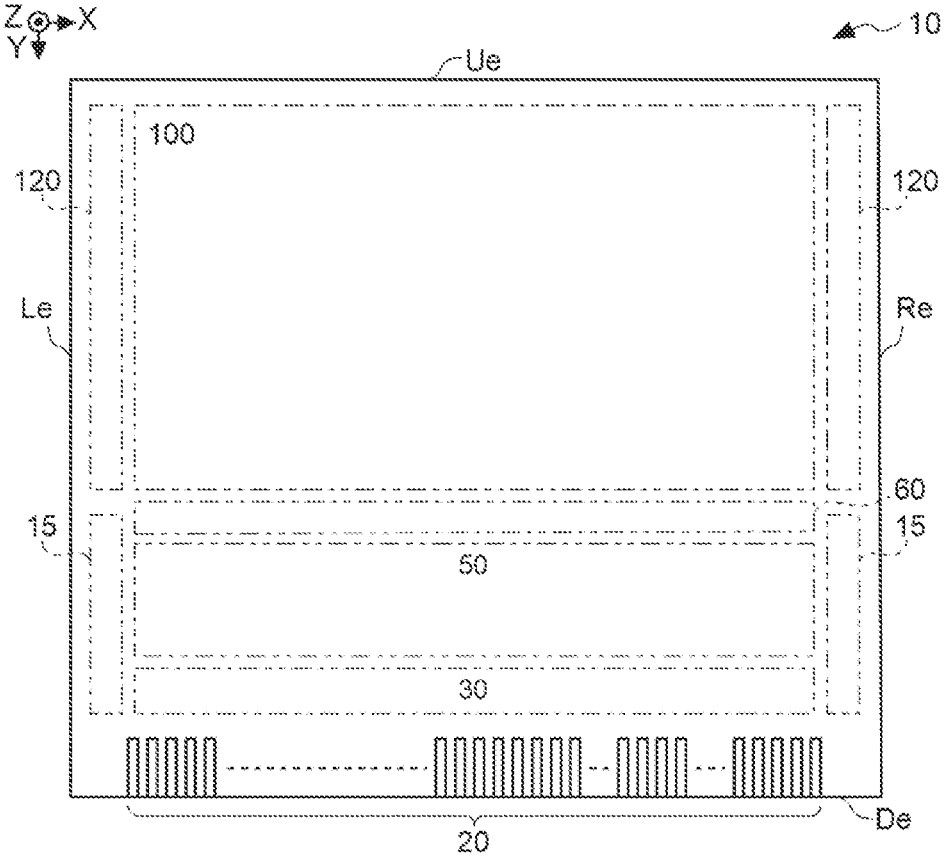
FIG. 11 is a plan view illustrating an arrangement of each element in the electro-optical device.

FIG. 11 is a plan view illustrating an arrangement of each element in the electro-optical device 10. The electro-optical device 10 has a rectangular shape because the electro-optical device 10 is diced from a wafer-shaped semiconductor substrate. Therefore, in the electro-optical device 10 having the rectangular shape, a reference numeral of an upper side is Ue, a reference numeral of a lower side is De, a reference numeral of a left side is Le, and a reference numeral of a right side is Re.

Note that, in the electro-optical device 10 having the rectangular shape, the upper side Ue and the lower side De are along the X direction, which is an extension direction of the scanning line 12, and the left side Le and the right side Re are along the Y direction, which is an extension direction of the data line 14. In addition, in the present description, viewing in plan view refers to a case where the electro-optical device 10 is viewed in a direction opposite to the Z direction.

The scanning line driving circuit 120 is provided in a region between the display region 100 and the left side Le, and the scanning line driving circuit 120 is provided in a region between the display region 100 and the right side Re. The two scanning line driving circuits 120 have the same configuration, and drive the scanning lines 12 from left and right.

In a configuration in which the scanning line driving circuit 120 is arranged only on one of the left and right sides, a signal delay occurs on another of the left and right sides. In contrast, in the configuration in which the scanning line driving circuits 120 are arranged on both the left and right sides, a signal delay can be prevented.

In the electro-optical device 10, a plurality of terminals 20 are provided along the lower side De. In a region between the display region 100 and the plurality of terminals 20, the initialization circuit 60, the data signal output circuit 50, and the control circuit 30 are provided in order from the display region 100.

The power supply circuit 15 is provided in a region between the data signal output circuit 50 and the left side Le, and the power supply circuit 15 is also provided in a region between the data signal output circuit 50 and the right side Re. The two power supply circuits 15 have the same configuration, and supply various potentials and voltages to the scanning line driving circuit 120, the data signal output circuit 50, the initialization circuit 60, and the control circuit 30.

Figure 12:
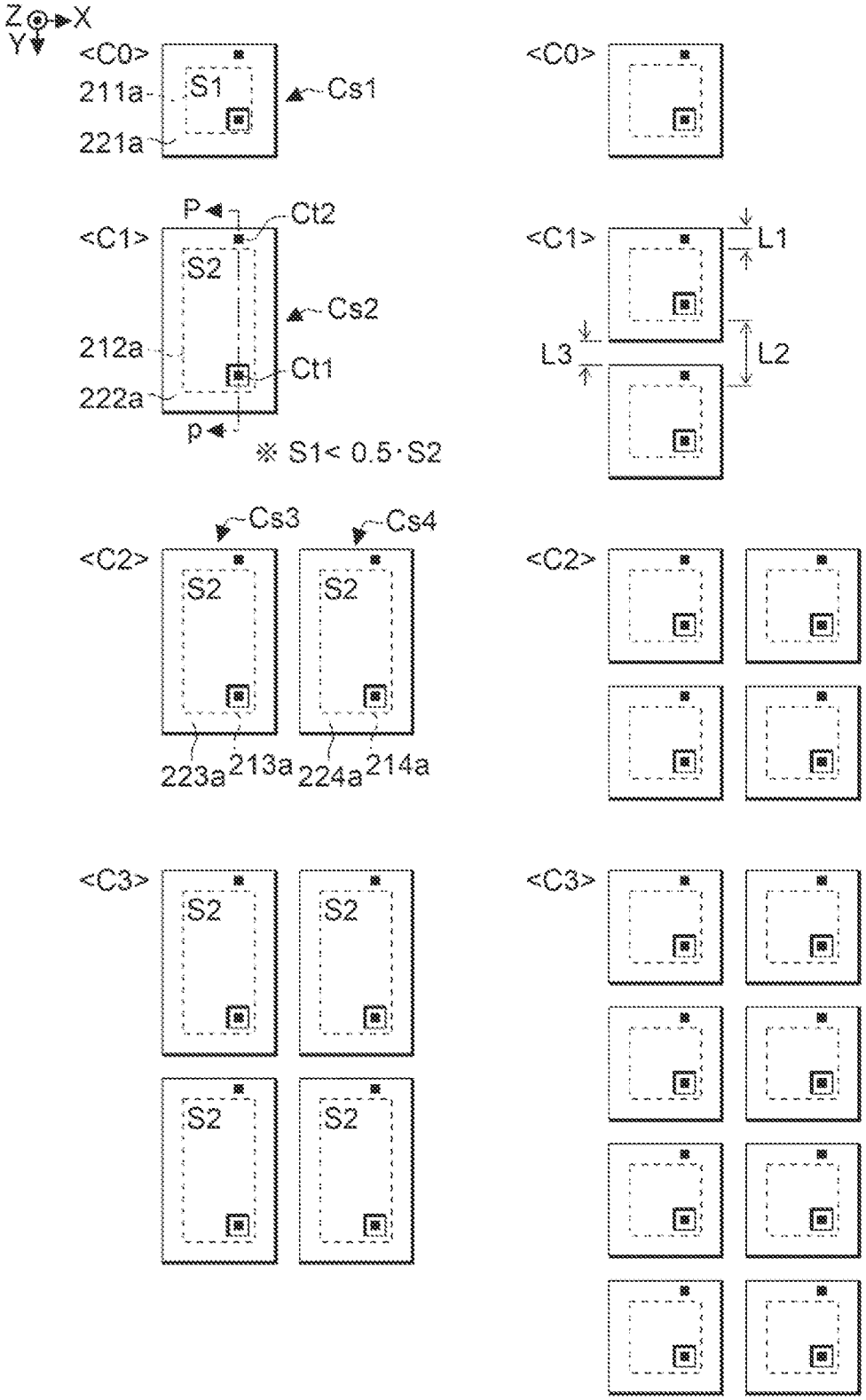
FIG. 12 is a diagram illustrating a configuration and an array of the capacitance elements in the DA conversion circuit.

A left section of FIG. 12 is a plan view illustrating a part of the DA conversion circuit 500 for one column included in the data signal output circuit 50. Specifically, the left section of FIG. 12 is a diagram illustrating a configuration and an arrangement of the capacitance elements C0 to C3 among the capacitance elements C0 to C9 in the DA conversion circuit 500 in plan view in a simplified manner. Note that, a right section of FIG. 12 is a diagram illustrating a comparative example of the capacitance elements C0 to C3.

When a capacitance element is formed by an MOS capacitance, a gate insulating layer or a transistor is sandwiched between a semiconductor layer serving as a lower electrode and a gate electrode layer serving as an upper electrode. In the example in the figure, the lower electrode is located at the back of the paper (in a direction opposite to the Z direction) with respect to the upper electrode, and is smaller than the upper electrode. Therefore, when viewed in plan view, the lower electrode is hidden by the upper electrode, and thus is indicated by dashed lines. Note that, the gate insulating layer is omitted in FIG. 12.

Ratios of the capacitance values of the respective capacitance elements C0 to C3 are 1:2:4:8 in order. Therefore, when the capacitance elements C0 to C3 are formed at a semiconductor substrate, it is sufficient that the capacitance element C0 having a smallest capacitance value is simply used as a basic capacitance element for the capacitance elements C1, C2, and C3, as illustrated in the comparative example in the right section, and a number of the basic capacitance elements corresponding to the ratios of the capacitance values are coupled in parallel. In particular, it is sufficient that two, four, and eight of the basic capacitance elements are coupled in parallel for the capacitance elements C1, C2, and C3, respectively.

However, when an MOS capacitance is formed at a semiconductor substrate, a plurality of capacitance elements need to be arrayed repeatedly in accordance with a process rule. Thus, in a configuration in which a plurality of the capacitance elements C0 having the smallest capacitance value are arrayed as the basic capacitance elements, a wide space is required to form a capacitance element unit in the DA conversion circuit 500.

Note that, in the process rule, a distance L1 is a distance that protrudes from an end side of one of the lower electrode and the upper electrode to the same end side at another end. When the plurality of basic capacitance elements are arrayed, a distance L2 is a distance between the lower electrodes in the respective basic capacitance elements adjacent to each other, and a distance L3 is a distance between the upper electrodes in the respective basic capacitance elements adjacent to each other.

When the basic capacitance elements are arrayed repeatedly, each of the distances L1, L2, and L3 needs to be designed to be equal to or greater than a certain value.

In the first exemplary embodiment, as illustrated in the left section of FIG. 12, the basic capacitance element is the capacitance element C1, rather than the capacitance element C0 having the small capacitance value. Note that, the capacitance element C1 is configured such that the gate insulating layer is sandwiched between a lower electrode 212*a* and an upper electrode 222*a*.

In such a configuration, the capacitance value Ctotal of a typical capacitance element is indicated by Equation (2) below.

$$Ctotal = Cus \cdot S + Cup \cdot P \tag{2}$$

In Equation (2), S is an area of a region where two electrodes overlap when viewed in plan view, and Cus is a capacitance value per unit area in the region. P is a perimeter of a smaller electrode of the two electrodes that overlap when viewed in plan view. The perimeter P can be referred to as a perimeter of the region where the two electrodes overlap when viewed in plan view. Further, Cup is a capacitance value per unit perimeter. In this way, the capacitance value Ctotal is affected not only by the area S of the region where the two electrodes overlap in plan view, but also by the perimeter P of the region.

The capacitance element C0 having the smallest capacitance value is configured such that a gate insulating layer is sandwiched between an electrode 211*a* and an upper electrode 221*a*, similarly to the capacitance element C1. Here, when an area of a region where the electrodes 211*a* and 221*a* overlap in plan view in the capacitance element C0 is S1, and is simply set to half an area S2 of a region where the elements 212*a* and 221*a* overlap in plan view in the capacitance element C1, which is the basic capacitance element, as can be seen from Equation (2), a capacitance value of the capacitance element C0 exceeds half a capacitance value of the capacitance element C1.

Thus, in the present exemplary embodiment, the area S1 is designed to be smaller than half the area S2 such that the capacitance value of the capacitance element C0 is half the capacitance value of the capacitance element C1. Specifically, when a perimeter of the capacitance element C0 is denoted as P1, and a perimeter of the capacitance element C1 is denoted as P2, the area S1 of the capacitance element C0 is set to satisfy Equation (3) below.

$$Cus \cdot S1 + Cup \cdot P1 = 0.5(Cus \cdot S2 + Cup \cdot P2)$$

$$Cus(S1 - 0.5 \cdot S2) + Cup(P1 - 0.5 \cdot P2) = 0 \tag{3}$$

When the region where the electrodes 211*a* and 221*a* overlap in the capacitance element C0 is, for example, a square, the perimeter P1 is $4(S1)^{1/2}$, and by substituting this into Equation (3), and solving Equation (3) for S1, it can be seen how much the area S1 needs to be reduced from half the area S2.

Note that, such a capacitance element C0 may be referred to as a first capacitance element Cs1, and the capacitance element C1 serving as the basic capacitance element may be referred to as a second capacitance element Cs2. The first capacitance element Cs1 (C0) includes the electrodes 211*a* and 221*a*, and of these, the electrode 211*a* is an example of a first electrode, and the electrode 221*a* is an example of a second electrode. The second capacitance element Cs2 (C1) includes the electrodes 212*a* and 222*a*, and of these, the electrode 212*a* is an example of a third electrode, and the electrode 222*a* is an example of a fourth electrode. Additionally, the area S1 is an example of a first area, and the area S2 is an example of a second area.

In the first exemplary embodiment, the capacitance element C2 that corresponds to the bit D2, and has a capacitance value twice that of the capacitance element C1 has a configuration in which two of the basic capacitance elements are coupled in parallel.

Specifically, the capacitance element C2 includes a third capacitance element Cs3 and a fourth capacitance element Cs4 coupled in parallel. The third capacitance element Cs3 has the same configuration as that of the second capacitance element Cs2, which is a basic capacitance element. Specifically, the third capacitance element Cs3 has a configuration in which a gate insulating layer is sandwiched between an electrode 213*a* and an electrode 223*a*, and an area of a region where the electrodes 213*a* and 223*a* overlap in plan view is substantially the same as the area S2. Similarly, the fourth capacitance element Cs4 has the same configuration as that of the second capacitance element Cs2, has a configuration in which a gate insulating layer is sandwiched between an electrode 214*a* and an electrode 224*a*, and an area of a region where the electrodes 214*a* and 224*a* overlap in plan view is substantially the same as the area S2.

Here, "substantially the same" for an area, in the same manner for the capacitance value, may include an error to some extent, as long as linearity of an output voltage when DA conversion is performed is held.

The electrode 213*a* of the third capacitance element Cs3 and the electrode 214*a* of the fourth capacitance element Cs4 constituting the capacitance element C2 are the same lower electrodes, and are island-shaped individual electrodes. The electrode 223*a* of the third capacitance element Cs3 and the electrode 234*a* of the fourth capacitance element Cs4 are the same upper electrodes, and are island-shaped individual electrodes.

Of the electrodes 213*a* and 223*a* included in the third capacitance element Cs3 in the capacitance element C2, the electrode 213*a* is an example of a fifth electrode, and the electrode 223*a* is an example of a sixth electrode. Of the electrodes 214*a* and 224*a* included in the fourth capacitance element Cs4 in the capacitance element C2, the electrode 214*a* is an example of a seventh electrode, and the electrode 224*a* is an example of an eighth electrode.

In addition, the bit D0 is an example of a first bit, and the bit D1 is an example of a second bit, and the bit D2 is an example of a third bit.

The capacitance element C3 that corresponds to the bit D3, and has a capacitance value four times that of the capacitance element C1 has a configuration in which four of the basic capacitance elements are coupled in parallel. Although omitted in FIG. 12 due to the paper space, the capacitance element C4 that corresponds to the bit D4, and has a capacitance value eight times that of the second capacitance element Cs2 (C1) has a configuration in which eight of the basic capacitance elements are coupled in parallel.

Figure 13:
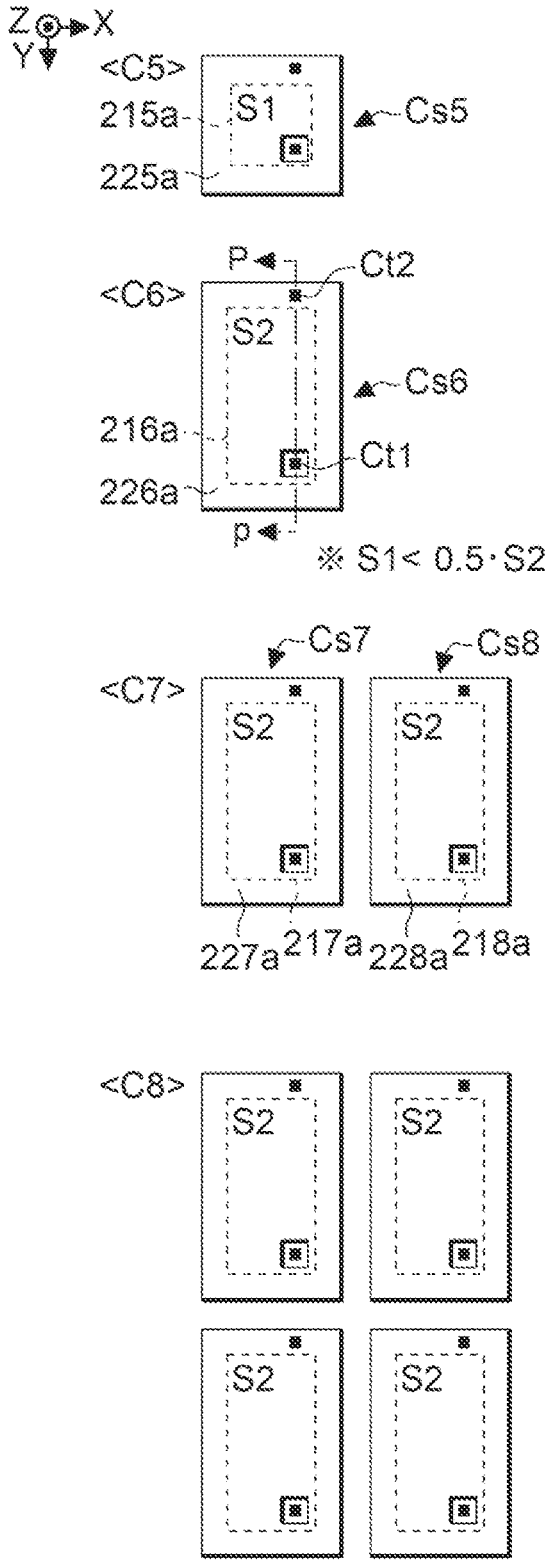
FIG. 13 is a diagram illustrating a configuration and an array of the capacitance elements in the DA conversion circuit.

The capacitance elements C5 to C8 also have configurations similar to those of the capacitance elements C0 to C3, respectively, as illustrated in FIG. 13.

Specifically, the capacitance element C5 is denoted as a fifth capacitance element Cs5, and the capacitance element C6 serving as a basic capacitance element is denoted as a sixth capacitance element Cs6. The fifth capacitance element Cs5 (C5) includes electrodes 215*a* and 225*a*, and of these, the electrode 215*a* is an example of a ninth electrode, and the electrode 225*a* is an example of a tenth electrode. The sixth capacitance element Cs6 (C6) includes electrodes 216*a* and 226*a*, and of these, the electrode 216*a* is an example of an eleventh electrode, and the electrode 226*a* is an example of a twelfth electrode.

The capacitance element C7 includes a seventh capacitance element Cs7 and an eighth capacitance element Cs8 coupled in parallel. The seventh capacitance element Cs7 has the same configuration as that of the second capacitance element Cs2, which is the basic capacitance element, and specifically, has a configuration in which a gate insulating layer is sandwiched between an electrode 217*a* and an electrode 227*a*, and an area of a region where the electrodes 217*a* and 227*a* overlap in plan view is substantially the same as S2. Similarly, the eighth capacitance element Cs8 has the same configuration as that of the second capacitance element Cs2, and has a configuration in which a gate insulating layer is sandwiched between an electrode 218*a* and the electrode 228*a*, and an area of a region where the electrodes 218*a* and 228*a* overlap in plan view is substantially the same as S2.

Of the electrodes 217*a* and 227*a* constituting the seventh capacitance element Cs7 in the capacitance element C7, the electrode 217*a* is an example of a thirteenth electrode, and the electrode 227*a* is an example of a fourteenth electrode. Of the electrodes 218*a* and 228*a* constituting the eighth capacitance element Cs8 in the capacitance element C7, the electrode 218*a* is an example of a fifteenth electrode, and the electrode 228*a* is an example of a sixteenth electrode.

In addition, the bit D5 is an example of a fourth bit, and the bit D6 is an example of a fifth bit, and the bit D7 is an example of a sixth bit.

The capacitance element C8 that corresponds to the bit D8, and has a capacitance value four times that of the capacitance element C6 has a configuration in which four of the basic capacitance elements are coupled in parallel. Although omitted in FIG. 13 due to the paper space, the capacitance element C9 that corresponds to the bit D4, and has a capacitance value eight times that of the sixth capacitance element Cs6 (C6) has a configuration in which eight of the basic capacitance elements are coupled in parallel.

Although omitted in FIG. 12 and FIG. 13, the capacitance element Cser, in the first exemplary embodiment, has the same configuration as that of the first capacitance element Cs1 (C0) or Cs5 (C5).

In FIG. 12 and FIG. 13, in order to simplify the description, only two electrode layers constituting each of the capacitance elements C0 to C9 are illustrated, and the gate insulating layer is omitted. In addition, an insulating layer and an electrode layer (not illustrated) are alternately stacked in the Z direction heading from the front of the paper.

Figure 14:
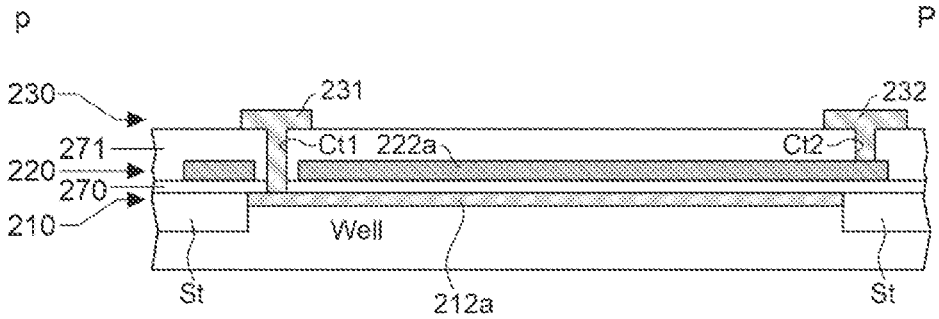
FIG. 14 is a partial cross-sectional view taken along a line P-p in FIG. 12.

FIG. 14 is a partial cross-sectional view of the second capacitance element Cs2 (C1), which is the basic capacitance element in FIG. 12, taken along the line P-p.

The electro-optical device 10 in the present exemplary embodiment is formed in the semiconductor substrate as described above, but in the semiconductor substrate, layers used as conductive layers or wiring layers of the second capacitance element Cs2 (C1) are a semiconductor layer 210, a gate electrode layer 220, and a first wiring layer 230 in order from a base material.

As described above, the second capacitance element Cs2 (C1) has a configuration in which a gate insulating layer 270 is sandwiched between the electrode 212*a* formed from the semiconductor layer 210, and the electrode 222*a* obtained by patterning the gate electrode layer 220.

Note that, the electrode 212*a* is formed by injection of impurity ions in a p-well region Well, for example. Additionally, a region St is a trench for separating regions of respective elements adjacent to each other.

The electrode 212*a* is coupled to a wiring line 231 via a contact hole Ct1 that opens the gate insulating layer 270 and a first interlayer insulating layer 271.

Further, the electrode 221*a* is coupled to a wiring line 232 via a contact hole Ct2 that opens the first interlayer insulating layer 271. The first interlayer insulating layer 271 is an insulating layer provided between the gate electrode layer 220 and the first wiring layer 230. The wiring line 231 and the wiring line 232 are relay wiring lines formed by patterning of the first wiring layer 230. One of the wiring lines 231 and 232 is coupled to one of the relay line 14*b* and the selection circuit 511, and another of the wiring line 231 and 232 is coupled to another or the relay line 14*b* and the selection circuit 511.

Note that, layers subsequent to the first wiring layer 230 and the first interlayer insulating layer 271 are not illustrated as described above.

When the capacitance element C0 having the smallest capacitance value is used as the base capacitance element, as in the comparative example illustrated in the right section of FIG. 12, the capacitance elements C1 to C4 (or C6 to C9) are configured by two, four, eight, and sixteen of the basic capacitance elements coupled in parallel, respectively, in order. In the parallel coupling, the adjacent basic capacitance elements need to be arrayed separately at intervals defined in the process rule, and thus a wide space for forming a capacitance element unit is required as the number of basic capacitance elements coupled in parallel increases.

As in the first exemplary embodiment, when the basic capacitance element is the second capacitance element Cs2 (Cs1), rather than the capacitance element C0 that has the smallest capacitance value, the capacitance elements C2 to C4 only need to be made of two, four, and eight of the basic capacitance elements coupled in parallel, respectively, in order. For example, even the capacitance element C4 (C9) having the greatest capacitance value only needs to be made of eight of the capacitance elements C1 (Cs2) coupled in parallel that are the basic capacitance elements. Thus, in the first exemplary embodiment, a space required to form the capacitance elements C0 to C4 (C5 to C9) can be reduced compared to the comparative example.

Additionally, in the first exemplary embodiment, for the first capacitance element Cs1 (C0), the area S1 of the region where the electrodes 211*a* and 221*a* overlap in plan view is smaller than half the area S2 of the region where the electrodes 212*a* and 222*a* overlap, while the perimeter P of the region is considered. Thus, the capacitance value of the first capacitance element Cs1 (C0) can be accurately set to half that of the second capacitance element Cs2 (Cs1). On the other hand, since the capacitance elements C2 to C4 (C7 to C9) are made of the two, four, eight second capacitance elements Cs2 (C1) that are the basic capacitance elements, respectively, coupled in parallel, capacitance values are accurately twice, four times, and eight times that of the second capacitance element Cs2 (C1), respectively.

Accordingly, it is possible to ensure linearity of voltage characteristics output from the DA conversion circuit 500 to the data line 14 for data constituted by the bits D0 to D9.

Second Exemplary Embodiment

Next, the electro-optical device 10 according to a second exemplary embodiments will be described. Note that, in the following, the same components as those in the above-described exemplary embodiment are denoted with the same reference numerals, and detail description thereof is omitted.

Figure 15:
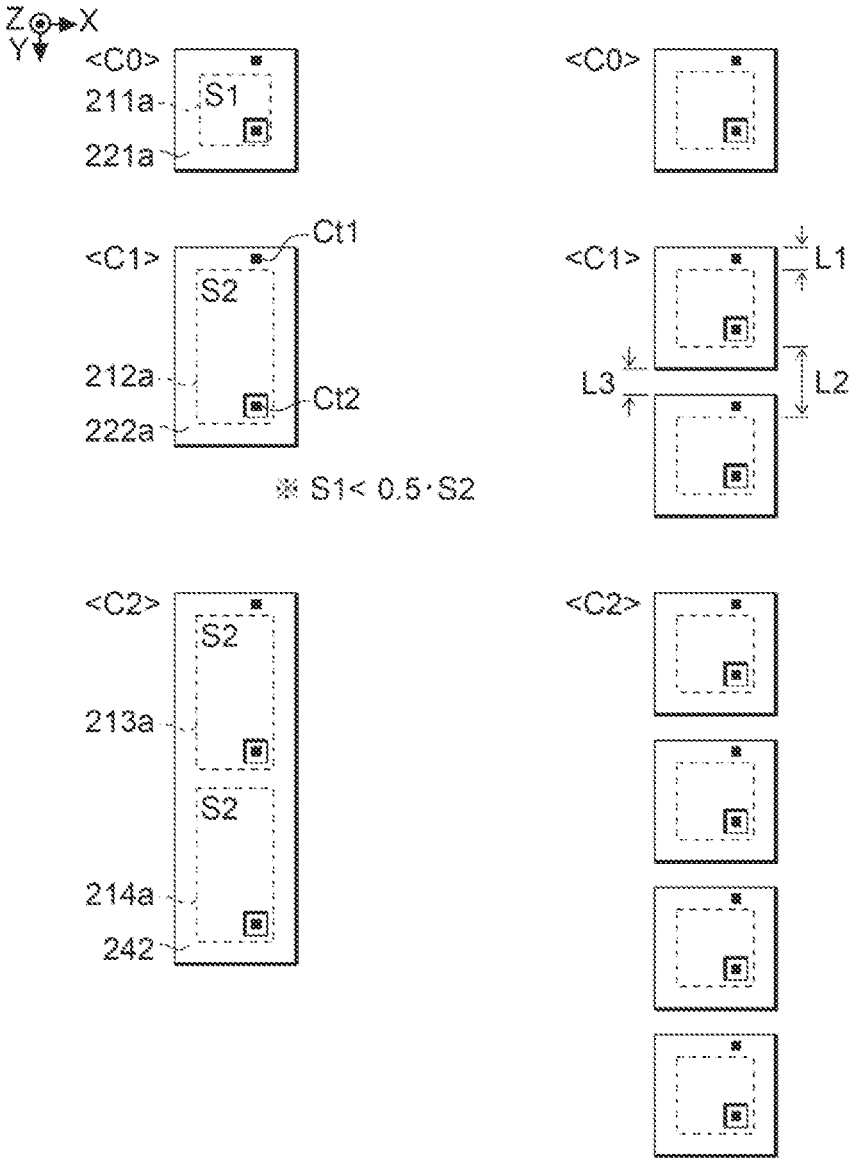
FIG. 15 is a diagram illustrating a configuration and an array of capacitance elements in a DA conversion circuit according to a second exemplary embodiment.

A left section of FIG. 15 is a diagram illustrating, in plan view, a configuration and an arrangement of the capacitance elements C0 to C2 among the capacitance elements C0 to C9 in the DA conversion circuit 500 according to the second exemplary embodiment. Note that, a right section of FIG. 15 is a diagram illustrating a comparative example of the capacitance elements C0 to C2. The right section of FIG. 15 is a diagram in which the four capacitance elements constituting the capacitance element C2 in the right section of FIG. 12 are rearranged in one column along the Y direction for convenience. Additionally, in the second exemplary embodiment, the capacitance elements C0 to C9 and Cser are MOS capacitances as in the first exemplary embodiment.

In the second exemplary embodiment, the capacitance elements C0 and C1 are similar to those of the first exemplary embodiment. That is, in the capacitance element C0 provided corresponding to the lowest bit D0, a gate insulating layer is sandwiched between the lower electrode 211*a* and the upper electrode 221*a*. The capacitance element C1 provided corresponding to the bit D1 at the second position is the basic capacitance element, and a gate insulating layer is sandwiched between the lower electrode 212*a* and the upper electrode 222*a*. The area S1 of a region where the electrodes 211*a* and the electrode 221*a* overlap in plan view is smaller than half the area S2 of a region where the electrode 212*a* and the electrode 222*a* overlap.

The capacitance element C2 in the second exemplary embodiment has a configuration in which the electrodes 223*a* and 224*a* included in the capacitance element C2 (refer to the left section of FIG. 12) in the first exemplary embodiment are replaced with an electrode 242 as a common electrode. In other words, the second exemplary embodiment is an example in which the electrode 223*a*, which is an example of the sixth electrode, and the electrode 224*a*, which is an example of the eighth electrode are replaced with the common electrode.

In the second exemplary embodiment, in the capacitance element C2, a gate insulating layer is sandwiched between the lower electrodes 213*a* and 214*a*, and the upper electrode 242. Each of the lower electrodes 213*a* and 214*a* is commonly coupled to a separate wiring line through a contact hole. Therefore, in the second exemplary embodiment, the capacitance element C2 has a configuration in which, two of the capacitance elements of the capacitance element in which the gate insulating layer is sandwiched between the electrodes 213*a* and 242, and the capacitance element in which the gate insulating layer is sandwiched between the electrodes 214*a* and 242 are coupled in parallel, thus a capacitance value of the capacitance element C2 is twice the capacitance value of the capacitance element C1.

Note that in the second exemplary embodiment, the capacitance element C3 provided corresponding to the bit D3 is omitted due to the paper space in FIG. 15, but has a configuration in which four of the lower electrodes 213*a* (or 214*a*) and an upper common electrode sandwich a gate insulating layer. The four lower electrodes are commonly coupled to a separate wiring line through contact holes. Thus, the capacitance element C3 has a configuration in which four of the capacitance elements equivalent to the capacitance element C1 are coupled in parallel, and a capacitance value of the capacitance element C3 is four times the capacitance value of the capacitance element C1.

The same applies to the capacitance element C4 provided corresponding to the bit D4, and the capacitance element C4 has a configuration in which eight of the lower electrodes 213*a* (or 214*a*) and an upper common electrode sandwich a gate insulating layer. The eight lower electrodes are commonly coupled to a separate wiring line through contact holes. Thus, the capacitance element C4 has a configuration in which the eight capacitance elements equivalent to the capacitance element C1 are coupled in parallel, and a capacitance value of the capacitance element C4 is eight times the capacitance value of the capacitance element C1.

The lower electrodes in the capacitance elements C2, C3, and C4 may be arrayed in one column along the Y direction, for example, or may be arrayed in two rows or two columns.

In the second exemplary embodiment, the capacitance elements C5 to C9 are not particularly illustrated, but are similar to the capacitance elements C0 to C4.

In the second exemplary embodiment, the lower electrode 212*a* in the capacitance element C1 is used as the basic electrode, and the two, four and eight upper electrodes are used in order in the capacitance elements C2, C3, and C4, respectively, and the upper electrode is formed to cover the basic electrodes. Thus, a process rule for separating the upper electrodes with distance L3 is mitigated.

Specifically, for example, the numbers of upper electrodes of the respective capacitance elements C1 to C4 are, in the first exemplary embodiment, "1", "2", "4", and "8" in order, whereas the numbers are all "1" in the second exemplary embodiment. Thus, in the second exemplary embodiment, a space for ensuring the distance L3 required for separating the upper electrodes is reduced, and thus a space required to form a capacitance element unit can be reduced in comparison to the first exemplary embodiment.

In the first exemplary embodiment or the second exemplary embodiment, the capacitance element C1 (C6) corresponding to the bit D1 (D6) is used as the basic capacitance element, but the reason for this will be described.

In order to accurately make a capacitance value twice, four times, eight times, or the like, a configuration may be adopted in which multiples of reference capacitance elements are coupled in parallel. However, as described above, when the capacitance element having the minimum capacitance value is used as the reference, the number of times of parallel coupling increases, which easily leads to an increase of an area of a capacitance element unit. On the other hand, for a capacitance element having a capacitance value smaller than that of a capacitance value of a reference capacitance element, an area of a region where two electrodes overlap in plan view may be smaller than half an area of a region where the two electrodes overlap in the reference capacitance element, in consideration of a perimeter, thus adjustment may be performed by modulation of the area.

Therefore, in such a manner that linearity of an output voltage due to an error of a capacitance value is not impaired, focusing on the bit D0 at the last position, which has the least influence, and the bit D1 which is next to the bit D0, the capacitance element C0 corresponding to the bit D0, and the capacitance element C1 of the bit D1 are adjusted with the area of the region where electrodes overlap, of these, the capacitance element C1 having a greater capacitance value is used as a reference, and the capacitance elements C2 to C4 subsequent to the bit D2 are configured by coupling the reference capacitance elements in parallel. In this way, when the capacitance element C1 corresponding to the bit D1 as the second position is used as the basic capacitance element, in order to prevent a gray scale level reversal described later, a sum of the capacitance value of the capacitance element C0 and the capacitance value of the capacitance element C1 as a ratio only needs to be adjusted so as not to exceed "3" ($=2^0+2^1$).

On the other hand, when the capacitance element C2 corresponding to the bit D2 at the third position is used as the basic capacitance element, in order to prevent the gray scale level reversal, a sum of the capacitance value of the capacitance element C0 and the capacitance value of the capacitance element C1 and the capacitance value of the capacitance element C2 as a ratio only needs to be adjusted so as not to 7 ($=2^0+2^1+2^2$), but this adjustment is difficult compared to a case where the capacitance element C1 is used as the basic capacitance element.

Therefore, as in the first or second exemplary embodiments, it can be said that a configuration is desirable in which the capacitance element C1 corresponding to the bit D1 at the next position of the last position is used as the basic capacitance element.

However, a configuration in which the capacitance element C2 corresponding to the bit D2 at the third position is used as the basic capacitance element only has difficulty adjusting among the capacitance values, as compared to the configuration in which the capacitance element C1 corresponding to the bit D1 at the second position is used as the basic capacitance element, and except for this point, the capacitance element C2 may be a basic capacitance element, and it can be said that the capacitance element C2 may be used as a basic capacitance element.

Third Exemplary Embodiment

Figure 16:
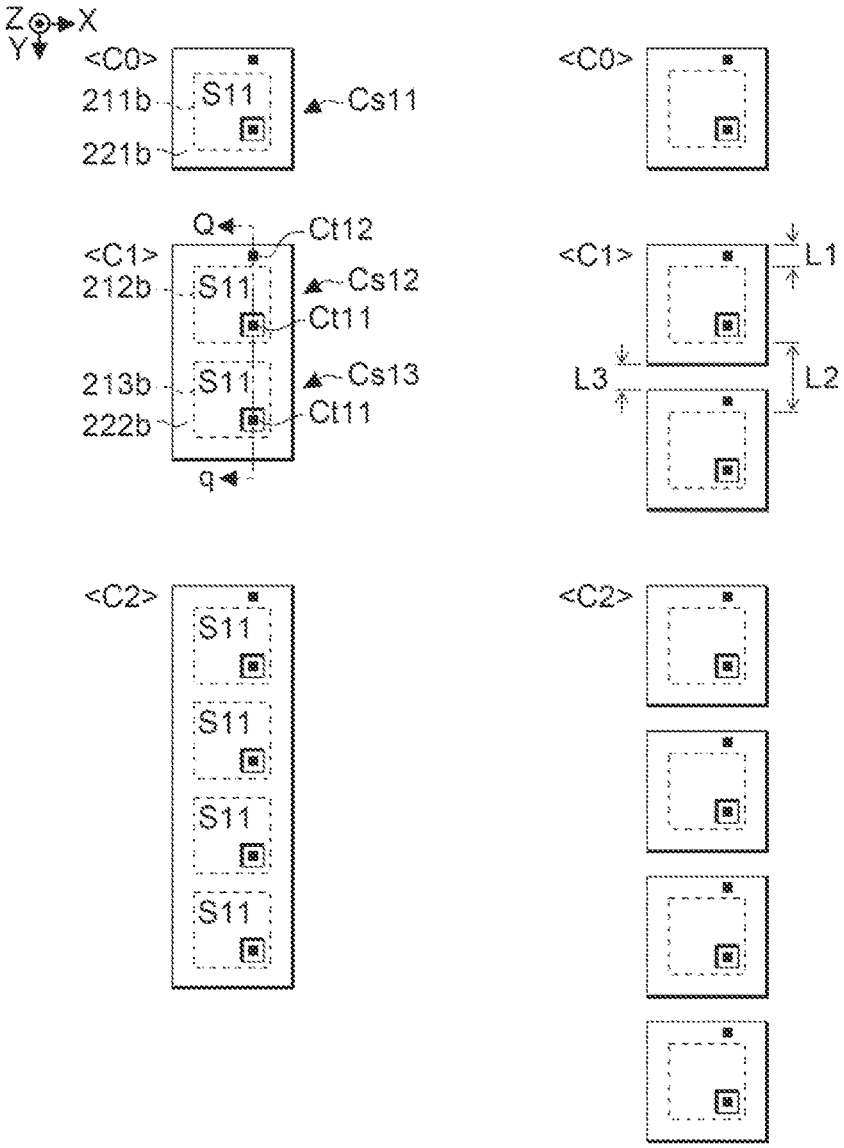
FIG. 16 is a diagram illustrating a configuration and an array of capacitance elements in a DA conversion circuit according to a third exemplary embodiment.

Next, the electro-optical device 10 according to a third exemplary embodiments will be described. A left section of FIG. 16 is a diagram illustrating, in plan view, a configuration and an arrangement of the capacitance elements C0 to C2 among the capacitance elements C0 to C9 in a DA conversion circuit according to the third exemplary embodiment. A right section of FIG. 16 is a diagram illustrating a comparative example of the capacitance element C0 to C2, and is a same diagram as that in the right section of FIG. 15. Note that in the third exemplary embodiment, the capacitance elements C0 to C9, and Cser are MOS capacitances as in the first and second exemplary embodiments.

In the third exemplary embodiment, the capacitance element C0 includes a lower electrode 211*b* and an upper electrode 221*b*. The lower electrode 211*b* and the upper electrode 221*b* are each substantially square, for example, and of both the electrodes, the upper electrode 221*b* is formed so as to cover the lower electrode 211*b* with a process rule of the distance L1. An area of a region where the electrodes 211*b* and 221*b* overlap in plan view is S11.

Note that, the area S11 in the capacitance element C0 of the third exemplary embodiment is different from the area S1 in the capacitance element C0 of the first exemplary embodiment and the second exemplary embodiment. Thus, the capacitance element C0 of the third exemplary embodiment may be denoted as a capacitance element Cs11.

The capacitance element C1 includes lower electrodes 212*b*, 213*b*, and one upper electrode 222*b*. The lower electrodes 212*b* and 213*b* are both similar to the electrode 211*b*, and for example, are both substantially square. The electrodes 212*b* and 213*b* are island-shaped individual electrodes that are separated in accordance with a process rule of the distance L2. The upper electrode 222*b* is rectangular and is formed to cover the electrodes 212*b* and 213*b* in accordance with a process rule of distance L1.

An area of a region where the lower electrode 212*b* and the upper electrode 222*b* overlap in plan view is substantially the same as the area S11. Additionally, an area of a region where the lower electrode 213*b* and the upper electrode 222*b* overlap in plan view is also substantially the same as the area S11.

Thus, a sum of the area of the region where the electrodes 212*b* and 222*b* overlap in plan view, and the area of the region where the electrodes 213*b* and 222*b* overlap in plan view in the capacitance element C1 is twice the area S11.

Each of the two lower electrodes 212*b* is commonly coupled to a wiring line in an upper layer than the upper electrode 222*b* via a contact hole Ct11. Therefore, the capacitance element C1 has a configuration in which two capacitance elements of a capacitance element having a gate insulating layer sandwiched between the electrodes 212*b* and 222*b*, and a capacitance element having a gate insulating layer sandwiched between the electrodes 213*b* and 222*b* are coupled in parallel. Thus, a capacitance value of the capacitance element C1 is twice a capacitance value of the capacitance element C0.

Note that, it can be rephrased that, the capacitance element C1 of the third exemplary embodiment is formed by coupling a capacitance element Cs12 having a gate electrode layer sandwiched between the electrodes 212*b* and 222*b*, and a capacitance element Cs13 having a gate electrode layer sandwiched between the electrodes 213*b* and 222*b* in parallel.

Note that, although reference numerals are omitted for the capacitance element C2, four lower electrodes are included, and are all substantially square, and have substantially the same shape as the electrode 211*b*. The four electrodes are separated, in accordance with the process rule of the distance L2. That is, the four lower electrodes are island-shaped individual electrodes. An upper electrode is rectangular and is formed to cover the four lower electrodes in accordance with the process rules of distance L1.

An area of a region where one lower electrode and the upper electrode overlap in plan view is substantially the same as the area S11, and thus a total area of a region where the four lower electrodes and the one upper electrode overlap in plan view in the capacitance element C2 is four times the area S11.

Each of the four lower electrodes is commonly coupled to a wiring line in a higher layer than the upper electrode via a contact hole. Thus, the capacitance element C2 has a configuration in which four capacitance elements each having a gate insulating layer sandwiched between four lower electrodes and one upper electrode are coupled in parallel. Thus, a capacitance value of the capacitance element C2 is four times the capacitance value of the capacitance element C0.

Note that, although the capacitance elements C3 and C4 are omitted in the third exemplary embodiment, the capacitance element C3 has eight lower electrodes, and an upper electrode is formed so as to cover the eight lower electrodes. Additionally, the capacitance element C4 has sixteen lower electrodes, and an upper electrode is formed so as to cover the eight lower electrodes.

The capacitance elements C5 to C9 are similar to the capacitance elements C0 to C4, and the capacitance element Cser is similar to the capacitance element C0 or C5.

Figure 17:
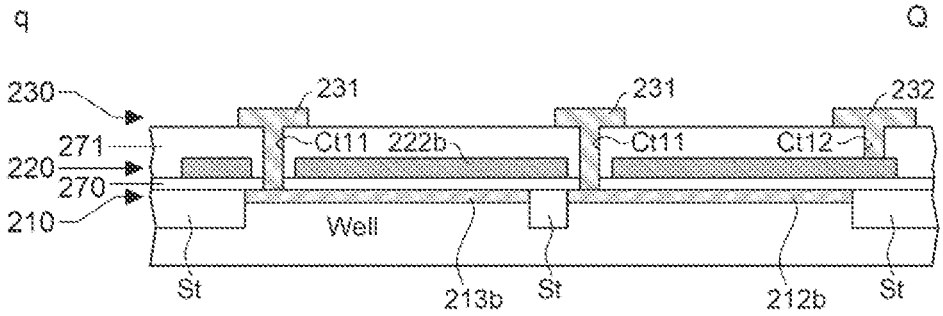
FIG. 17 is a partial cross-sectional view taken along a line Q-q in FIG. 16.

FIG. 17 is a partial cross-sectional view of the capacitance element C1 taken along the line Q-q in FIG. 16.

The capacitance element C1 in the third exemplary embodiment has a configuration in which the gate insulating layer 270 is sandwiched between two of the electrode 212*b* formed from the semiconductor layer 210, and the electrode 222*b* obtained by patterning the gate electrode layer 220.

The two electrodes 212*b* are each commonly coupled to the wiring line 231 via the contact hole Ct11 that opens the gate insulating layer 270 and the first interlayer insulating layer 271.

Further, the electrode 222*b* is coupled to the wiring line 232 via a contact hole Ct12 that opens the first interlayer insulating layer 271. Layers subsequent to the first wiring layer 230 and the first interlayer insulating layer 271 are not illustrated.

Note that in the third exemplary embodiment, the capacitance element Cs11 (C0) is an example of a capacitance element provided corresponding to a single bit, and the capacitance elements Cs12 and Cs13 constituting the capacitance element C1 are an example of two capacitance elements provided corresponding to another bit.

In the capacitance elements C0 to C4 (or C5 to C9) in the DA conversion circuit 500, when the capacitance element C0 having the smallest capacitance value is used as the base capacitance element, as in the comparative example illustrated in the right section of FIG. 16, the capacitance elements C1 to C4 (or C6 to C9) are configured by two, four, eight, and sixteen of the basic capacitance elements coupled in parallel, respectively, in order. Therefore, as the number of basic capacitance elements coupled in parallel increases, a space required to form a capacitance element unit becomes wider as described above.

In the third exemplary embodiment, the lower electrode 212*a* in the capacitance element C1 is used as the basic electrode, and the two, four and eight upper electrodes are used in order in the capacitance elements C2, C3, and C4, respectively, and the upper electrode is formed to cover the basic electrodes. Thus, the process rule for separating the lower electrodes with distance L2 is mitigated.

Specifically, for example, the numbers of lower electrodes of the respective capacitance elements C1 to C4 are, in the second exemplary embodiment, "2", "4", "8", and "16" in order, whereas the numbers are "1", "2", "4", and "8" in the third exemplary embodiment. Thus, in the third exemplary embodiment, a space for ensuring the distance L2 required for separating the lower electrodes is reduced.

Also, the numbers of upper electrodes in the capacitance elements C1 to C4 are all "1", as in the case of the second exemplary embodiment, thus, a space for ensuring the distance L3 required for separating the upper electrodes is reduced. Thus, in the third exemplary embodiment, a region required to form a capacitance element unit can be reduced in comparison to the first exemplary embodiment.

Fourth Exemplary Embodiment

In the first exemplary embodiment to the third exemplary embodiment, a ratio of a capacitance value in the capacitance element Cser is "1", which is the same as the ratio of the capacitance value of the capacitance element C0 (C5), but may be other than "1". Specifically, the ratio of the capacitance value of the capacitance element Cser may be greater than the ratio of the capacitance value of the capacitance element C0 (C5). However, when the capacitance value of the capacitance element Cser is greater than the capacitance value of the capacitance element C0 (C5), the compression ratio k is greater than 1/32 as can be seen by Equation (1). That is, voltage characteristics (inclination) in the second DA conversion circuit portion Lwb are greater than 1/32 of voltage characteristics of the first DA conversion circuit unit Upb.

Note that, the voltage characteristics by the second DA conversion circuit unit Lwb are voltage characteristics when data of five bits including the bits D0 to D4 is converted and output to the data line 14 via the capacitance element Cser, and the voltage characteristics by the first DA conversion circuit unit Upb are voltage characteristics when data of five bits including the bits D5 to D9 is converted and directly output to the data line 14.

Therefore, in the configuration in which the ratio of the capacitance value in the capacitance element Cser is simply made greater than "1", the linearity of the voltage characteristics output by the DA conversion circuit 500 is impaired. Specifically, characteristics are the same as a dashed line Vcr_d indicated in FIG. 18, when a horizontal axis indicates decimal value of a gray scale level indicated by the ten bits of the bits D0 to D9, and a vertical axis indicates amount of rise from the voltage of the data line 14 at the end of the reset period in the DA conversion circuit 500. In other words, every 2 to the fifth power (=32) of a gray scale level, an output voltage falls.

Note that, when the output voltage falls in this manner, for example, luminance of a display element when a gray scale level is "31" is to be lower than luminance of the display element when the gray scale level is "32", but in practice, a reverse phenomenon occurs in which, the luminance of the display element when the gray scale level is "31" is higher than the luminance of the display element when the gray scale level is "32". Such a reverse phenomenon may be referred to as a gray scale level reversal since brightness/darkness in accordance with a gray scale level is reversed and light is emitted with luminance of darkness/brightness in a display element. When the reverse phenomenon (gray scale level reversal) occurs, display quality is significantly impaired.

Thus, in the fourth exemplary embodiment, the capacitance value of the capacitance element Cser is set to, for example, twice the capacitance value of the capacitance element C0 (C5), and the potential VPL is set to be lower than the potential VPH. When the capacitance value of the capacitance element Cser is twice the capacitance value of the capacitance element C0 (C5), the compression ratio k is 2/33 (=1/(2+1+2+4+8+16). At this time, when the potential VPL is set to be lower than the potential VPH, and for example, only the D0 and D5 are "1" of the bits D0 to D9, an amount of rise at the other end of the capacitance element C0 corresponding to the bit D0 is lower compared to an amount of rise at the other end of the capacitance element C5 corresponding to the bit D5. Here, although the relationship between the capacitance elements C0 and C5 has been described, the same applies to the other capacitance elements having the same ratio of capacitance value, specifically, to the capacitance elements C1 and C6, the capacitance elements C2 and C7, the capacitance elements C1 and C8, and the capacitance elements C4 and C9.

In this way, when the potential VPL is lower than the potential VPH, the amount of rise at the other end of each of the capacitance element C0 to C4 is lower than the amount of rise at the other end of each of the capacitance element C5 to C9, and an effect due to the increase of the compression ratio k is canceled. Thus, when the potential VP is set to be appropriately lower than the potential VPH, good linearity of output characteristics can be ensured as indicated by a solid line Vcr_e in FIG. 18.

Figure 18:
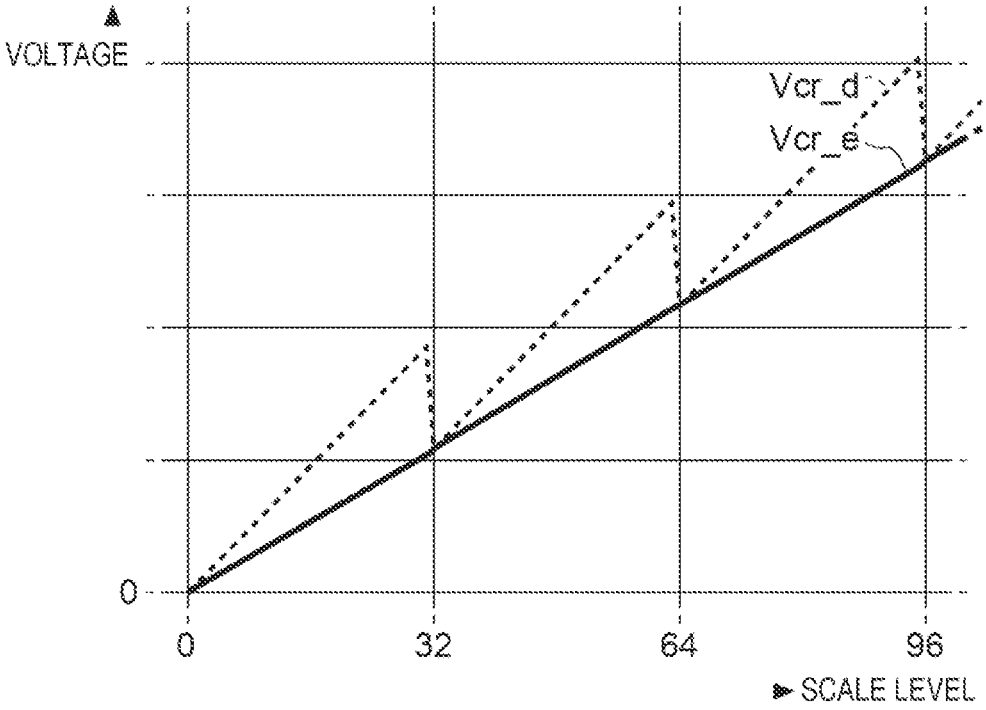
FIG. 18 is a diagram illustrating output characteristics of a DA conversion circuit according to a fourth exemplary embodiment.

Note that, the solid line Vcr_e in FIG. 18 is an example of a case in which the capacitance value of the capacitance element Cser is twice the capacitance value of the capacitance element C0 (C5), and a case in which the potential (voltage) VPL is 2.2 V, and the potential VPH is 4.0 V.

As in the case of the first exemplary embodiment, when a case in which the potential VPL=the potential VPH is used as a reference, it is also conceivable to maintain the potential VPL to make the potential VPH higher than the potential VPL, in order to lower the potential VPL relative to the potential VPH. However, there is a case in which it is not possible to raise the potential of the potential VPH from the first exemplary embodiment due to the configuration of the power supply circuit 15, and thus the method of lowering the potential VPL from the first exemplary embodiment is effective.

Figure 19:
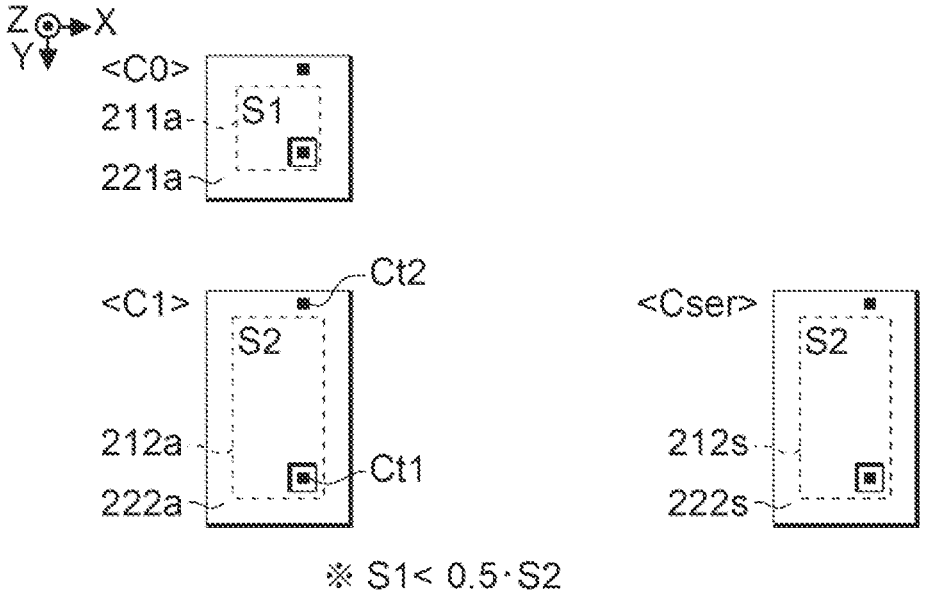
FIG. 19 is a diagram illustrating a configuration of a DA capacitance element Cser.

When the capacitance value of the capacitance element Cser is twice the capacitance value of the capacitance element C0 (C5), the capacitance element Cser may be configured to be similar to the capacitance element C1 (Cs1) in the first exemplary embodiment (see FIG. 12), as illustrated in FIG. 19. Specifically, the capacitance element Cser has a configuration in which a gate insulating layer is sandwiched between a lower electrode 212*s* and an upper electrode 222*s*, and the electrode 212*s* has approximately the same shape as the electrode 212*a*. Thus, an area of a region where the electrode 212*s* and the electrode 222*s* overlap in plan view is substantially the same as the area S2 of a region where the electrode 212*a* and the electrode 222*a* overlap.

Note that, the electrode 212*s* is an example of a seventeenth electrode, and the electrode 222*s* is an example of an eighteenth electrode. Additionally, in the fourth exemplary embodiment, the capacitance value of the capacitance element Cser is twice the capacitance value of the capacitance element C0 (C5), but the capacitance value of the capacitance element Cser only needs to be greater than the capacitance value of the capacitance element C0 (C5). That is, the area of the region where the electrode 212*s* and the electrode 222*s* overlap in plan view only needs to be greater than the area S1 of the region where the electrode 211*a* and the electrode 221*a* overlap.

Application Example/Modified Example

The DA conversion circuit 500 according to the various exemplary embodiments described above (hereinafter referred to as "exemplary embodiments and the like") has the configuration including the first DA conversion circuit unit Upb, the second DA conversion circuit unit Lwb, and the capacitance element Cser in view of application to the electro-optical device 10. Specifically, the configuration is adopted in which, among the ten bits, which is data before conversion, the higher bits D5 to D9 are converted to a voltage by the first DA conversion circuit unit Upb, and output to the data line 14, and the lower bits D0 to D4 are converted to a voltage by the second DA conversion circuit unit Lwb, compressed by the capacitance element Cser and the like with the compression ratio k, and output to the data line 14. The DA conversion circuit 500 is not limited to such a configuration. For example, when converting three bits of the bits D0 to D2, the DA conversion circuit 500 may be configured as illustrated in FIG. 20.

In such a configuration, in a reset period, the switch Rsw is brought into the on state, and the selection circuits 510 to 512 select the potential VL. In this way, in the reset period, each of the capacitance elements C0 to C2 is charged with a voltage (Vrst−VL), and charges corresponding to the weights of the bits D0 to D2 are accumulated.

In an output period, each of the selection circuits 510 to 512 maintains selection of the potential VL when a corresponding bit is "0", and switches to selection of the potential VPL when the corresponding bit is "1".

Figure 20:
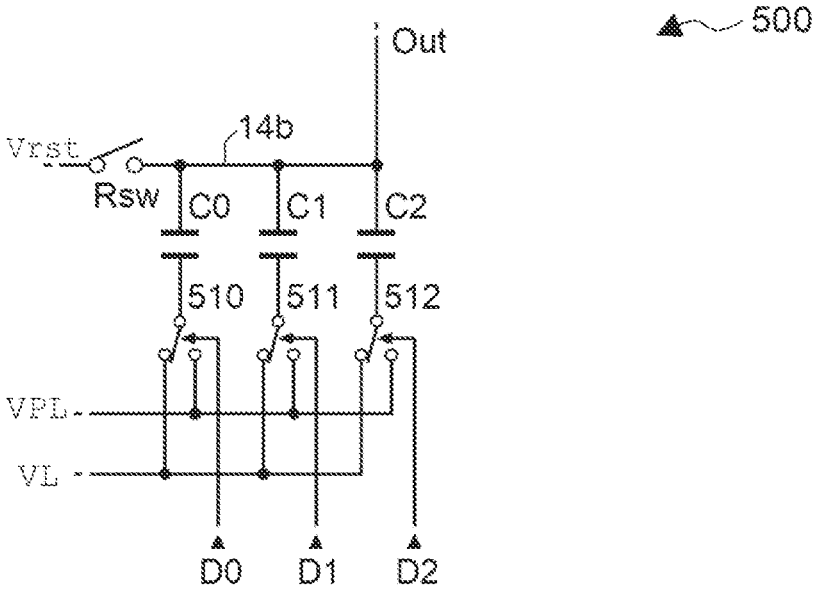
FIG. 20 is a diagram illustrating a configuration of a DA conversion circuit according to an application example.

In this way, the DA conversion circuit 500 illustrated in FIG. 20 can increase a voltage of the output end Out from the potential Vrst to a voltage corresponding to the bits D0 to D2.

Note that, for example, for the capacitance elements C0 to C2 of the DA conversion circuit 500 illustrated in FIG. 20, the capacitance element C1 is basic capacitance element, as illustrated in FIG. 12. The capacitance element C2 is configured such that two basic capacitance elements are coupled in parallel, and the area S1 of a region where the electrodes 211*a* and 212*a* overlap in plan view in the capacitance element C0 is smaller than half the area S2 of a region in which the electrodes 212*a* and 222*a* of the capacitance element C1, which is the basic capacitance element, overlap.

Further, in the exemplary embodiment and the like, the OLED 130 has been illustrated and described as an example of the display element, but other display elements may be used. For example, an LED may be used as the display element, or a liquid crystal element may be used. That is, as the display element, it is sufficient that an electro-optical element is used that is brought into an optical state in accordance with a voltage of a data signal output from the DA conversion circuit 500.

In the exemplary embodiment and the like, the conversion example of the ten bits has been illustrated as the DA conversion circuit 500, but it is sufficient that the number of bits is equal to or greater than three, as in the example illustrated in FIG. 20.

In the exemplary embodiment, the upper electrode has been formed to be wider to cover the lower electrode in plan view, but conversely, the lower electrode may be formed to be wider than the lower electrode.

In the exemplary embodiments and the like, the configuration has been adopted in which the threshold voltage of the transistor 121 in the pixel circuit 110 is compensated for, but a configuration in which the threshold voltage is not compensated for, specifically, a configuration in which the transistor 123 is omitted may be adopted.

The channel type of each of the transistors 66, 121 to 125 is not limited to the exemplary embodiments and the like. Further, these transistors 66, 121 to 125 may also be replaced by transmission gates as appropriate. Conversely, the transmission gates Tg0 to Tg2 may be replaced with one channel type of transistors.

Electronic Apparatus

Next, an electronic apparatus to which the electro-optical device 10 according to the above-described exemplary embodiments is applied will be described. The electro-optical device 10 is suitable for application with a small pixel and high definition display. In this regard, a head-mounted display will be described as an example of the electronic apparatus.

Figure 21:
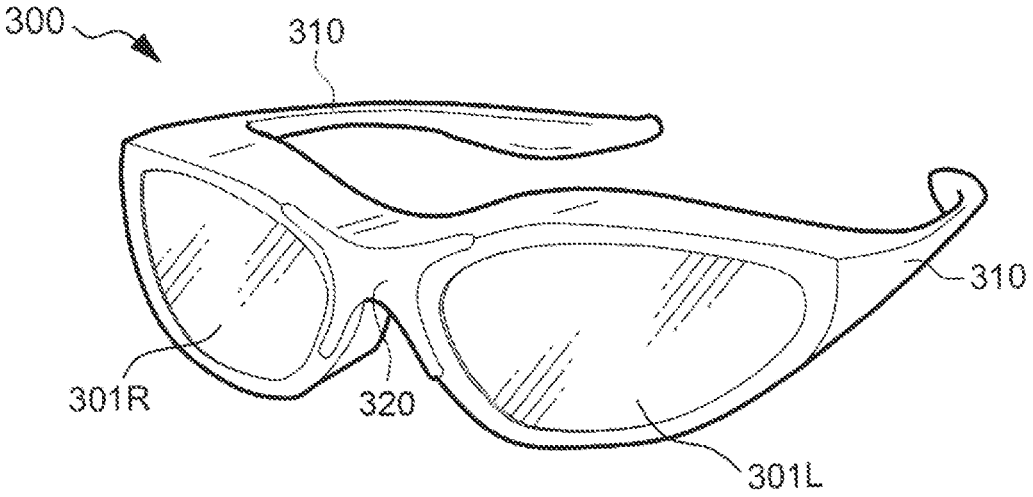
FIG. 21 is a perspective view illustrating a head-mounted display using an electro-optical device.
Figure 22:
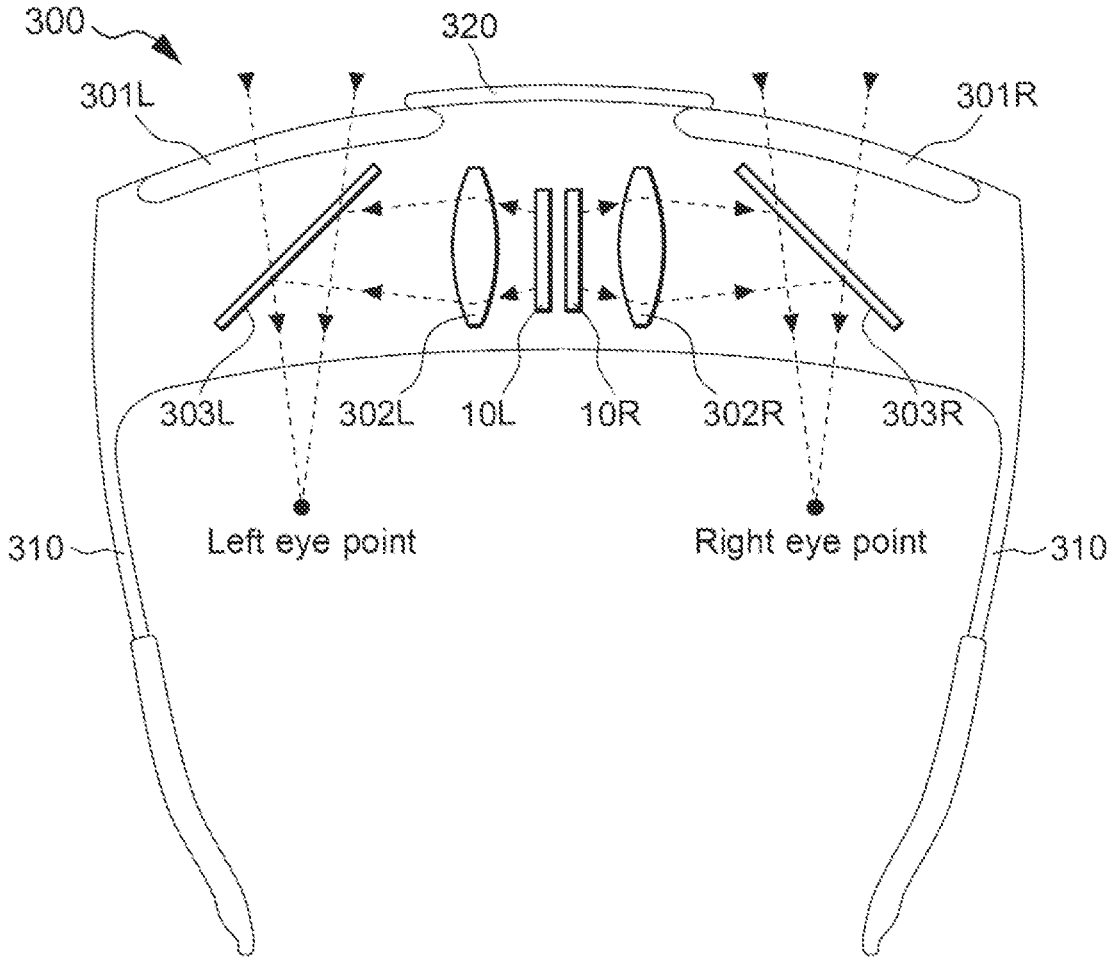
FIG. 22 is a diagram illustrating an optical configuration of the head-mounted display.

FIG. 21 is a diagram illustrating appearance of a head-mounted display, and FIG. 22 is a diagram illustrating an optical configuration of the head-mounted display.

First, as illustrated in FIG. 21, a head-mounted display 300 includes, in terms of appearance, temples 310, a bridge 320, and lenses 301L and 301R, as with typical eye glasses. In addition, as illustrated in FIG. 22, the head-mounted display 300 is provided with an electro-optical device 10L for a left eye and an electro-optical device 10R for a right eye in a vicinity of the bridge 320 and on a back side (a lower side in the figure) of the lenses 301L and 301R.

An image display surface of the electro-optical device 10L is arranged to be on the left side in FIG. 22. According to this configuration, a display image by the electro-optical device 10L is output via an optical lens 302L in a 9-o'clock direction in the figure. A half mirror 303L reflects the display image by the electro-optical device 10L in a 6-o'clock direction, while the half mirror 303L transmits light entering in a 12-o'clock direction. An image display surface of the electro-optical device 10R is arranged on the right side opposite to the electro-optical device 10L. According to this configuration, a display image by the electro-optical device 10R is output via an optical lens 302R in a 3-o'clock direction in the figure. A half mirror 303R reflects the display image by the electro-optical device 10R in the 6-o'clock direction, while the half mirror 303R transmits light entering in the 12-o'clock direction.

In this configuration, a wearer of the head-mounted display 300 can observe the display images by the electro-optical devices 10L and 10R in a see-through state in which the display images by the electro-optical devices 10L and 10R overlap with an outside.

In addition, in the head-mounted display 300, of images for both the eyes with parallax, an image for the left eye is displayed by the electro-optical device 10L, and an image for the right eye is displayed by the electro-optical device 10R, and thus, it is possible to cause the wearer to sense the displayed images as an image displayed having a depth or a three dimensional effect.

Note that, in addition to the head-mounted display 300, an electronic apparatus including the electro-optical device 10 can be applied to an electronic viewing finder in a video camera, a lens-exchangeable digital camera, or the like, a personal digital assistant, a display unit of a wrist watch, a light valve in a projection type projector, and the like.

Supplementary Note

A DA conversion circuit according to an aspect (Aspect 1) includes a capacitance element unit including a capacitance element having a capacitance value corresponding to a weight of each bit, wherein the capacitance element unit includes a first capacitance element provided corresponding to a first bit, a second capacitance element provided corresponding to a second bit having a greater weight than that of the first bit, and a third capacitance element and a fourth capacitance element, provided corresponding to a third bit having a greater weight than that of the second bit, and electrically coupled in parallel, the first capacitance element includes a first electrode and a second electrode, the second capacitance element includes a third electrode and a fourth electrode, the third capacitance element includes a fifth electrode and a sixth electrode, the fourth capacitance element includes a seventh electrode and an eighth electrode, a first area in which the first electrode and the second electrode overlap in plan view is less than half a second area in which the third electrode and the fourth electrode overlap in plan view, an area in which the fifth electrode and the sixth electrode overlap in plan view is substantially the same as the second area, and an area in which the seventh electrode and the eighth electrode overlap in plan view is substantially the same as the second area.

In Aspect 1, the capacitance element provided corresponding to the third bit is configured by coupling capacitance elements in parallel, that are similar to the capacitance element provided corresponding to the second bit. Thus, according to Aspect 1, in the capacitance elements provided corresponding to the second and subsequent bits, the number of capacitance elements coupled in parallel is reduced, as compared to the configuration in which the capacitance elements that are similar to the capacitance element provided corresponding to the first bit are coupled in parallel, and thus a space for separating the capacitance elements is reduced, and space saving can be achieved.

A DA conversion circuit according to a specific aspect of Aspect 1 (Aspect 2) includes a first conversion circuit unit corresponding to higher bits of a plurality of bits, a second conversion circuit unit corresponding to lower bits, and a coupling capacitance provided between the first conversion circuit unit and the second conversion circuit unit, the second conversion circuit unit being the DA conversion circuit according to claim 1, wherein the first conversion circuit unit includes a fifth capacitance element provided corresponding to a fourth bit of the higher bits, a sixth capacitance element provided corresponding to a fifth bit having a greater weight than that of the fourth bit, and a seventh capacitance element and an eighth capacitance element, provided corresponding to a sixth bit having a greater weight than that of the fifth bit, and electrically coupled in parallel, the fifth capacitance element includes a ninth electrode and a tenth electrode, the sixth capacitance element includes an eleventh electrode and a twelfth electrode, the seventh capacitance element includes a thirteenth electrode and a fourteenth electrode, the eighth capacitance element includes a fifteenth electrode and a sixteenth electrode, an area in which the ninth electrode and the tenth electrode overlap in plan view is substantially the same as the first area, an area in which the eleventh electrode and the twelfth electrode overlap in plan view is substantially the same as the second area, an area in which the thirteenth electrode and the fourteenth electrode overlap in plan view is substantially the same as the second area, and an area in which the fifteenth electrode and the sixteenth electrode overlap in plan view is substantially the same as the second area.

According to Aspect 2, the capacitance element provided corresponding to the sixth bit is configured by coupling capacitance elements in parallel that are similar to the capacitance element provided corresponding to the fifth bit, and thus space saving can be achieved.

In a DA conversion circuit according to a specific aspect of Aspect 2 (Aspect 3), the coupling capacitance includes a seventeenth electrode and an eighteenth electrode, and an area in which the seventeenth electrode and the eighteenth electrode overlap in plan view is greater than the first area.

According to Aspect 3, since an output voltage by the second DA conversion circuit unit is compressed and output as compared to an output voltage by the first DA conversion circuit unit, a plurality of bits can be converted to a voltage corresponding to a weight by the first DA conversion circuit unit and the second DA conversion circuit unit, and can be output.

In a DA conversion circuit according to a specific aspect of any one of Aspects 1 to 3 (Aspect 4), each of the fifth electrode and the seventh electrode is an individual electrode provided in an island shape, and each of the sixth electrode and the eighth electrode is an individual electrode provided in an island shape.

In addition, in a DA conversion circuit according to a specific aspect (Aspect 5) of any one of Aspects 1 to 3, each of the fifth electrode and the seventh electrode is an individual electrode provided in an island shape, and the sixth electrode and the eighth electrode are common electrodes.

A DA conversion circuit according to another aspect (Aspect 6) includes a capacitance element unit including a capacitance element having a capacitance value corresponding to a weight of each bit, the capacitance element unit includes a capacitance element provided corresponding to one bit of a plurality of bits, and two capacitance elements provided corresponding to another bit having a greater weight than that of the one bit, of the plurality of bits, an area in which one electrode and another electrode of the capacitance element in the capacitance element provided corresponding to the one bit overlap in plan view is substantially the same as an area in which one electrode and another electrode of each of the two capacitance elements overlap in plan view, the one electrode of each of the two capacitance elements is provided in an island shape, and the other electrode of each of the two capacitance elements is a common electrode.

In Aspect 6, in the two capacitance elements provided corresponding to the other bit, a space for separating the electrodes on one side is reduced, and thus space saving can be achieved.

In an electro-optical device according to Aspect 7, data of a plurality of bits is converted into a data signal by the DA conversion circuit of any one of Aspect 1 to Aspect 6, and an electro-optical element that is brought into an optical state based on the data signal is included. According to the electro-optical device according to Aspect 7, it is possible to save space.

Also, an electronic apparatus according to Aspect 8 includes the electro-optical device according to Aspect 7.

What is claimed is:

1. An electro-optical device, comprising:

a DA conversion circuit including a capacitance element unit including:

a first capacitance element corresponding to a first bit and including a first electrode and a second electrode;

a second capacitance element corresponding to a second bit having a greater weight than that of the first bit, the second capacitance element including a third electrode and a fourth electrode; and a third capacitance element and a fourth capacitance element, corresponding to a third bit having a greater weight than that of the second bit, and electrically coupled in parallel, the third capacitance element including a fifth electrode and a sixth electrode, the fourth capacitance element including a seventh electrode and an eighth electrode;

a data line;

an electro-optical element; and a transistor corresponding to the electro-optical element and electrically connected to DA conversion circuit via the data line, wherein a first area in which the first electrode and the second electrode overlap in plan view is less than half a second area in which the third electrode and the fourth electrode overlap in the plan view, an area in which the fifth electrode and the sixth electrode overlap in the plan view is substantially the same as the second area, and an area in which the seventh electrode and the eighth electrode overlap in the plan view is substantially the same as the second area.

2. An electro-optical device, comprising:

a first conversion circuit unit corresponding to higher bits of a plurality of bits, the first conversion circuit including:

a fifth capacitance element corresponding to a fourth bit of the higher bits and including a ninth electrode and a tenth electrode;

a sixth capacitance element corresponding to a fifth bit having a greater weight than that of the fourth bit, the sixth capacitance element including an eleventh electrode and a twelfth electrode; and a seventh capacitance element and an eighth capacitance element, corresponding to a sixth bit having a greater weight than that of the fifth bit, end electrically coupled in parallel, the seventh capacitance element including a thirteenth electrode and a fourteenth electrode, the eighth capacitance element including a fifteenth electrode and a sixteenth electrode;

a second conversion circuit unit corresponding to lower bits, the second conversion circuit including:

first capacitance element corresponding to a first bit and including a first electrode and a second electrode, a second capacitance element corresponding to a second bit having a greater weight than that of the first bit, the second capacitance element including a third electrode and a fourth electrode; and a third capacitance element and a fourth capacitance element, corresponding to a third bit having a greater weight than that of the second bit, and electrically coupled in parallel, the third capacitance element including a fifth electrode and a sixth electrode, the fourth capacitance element including a seventh electrode and an eighth electrode;

a coupling capacitance between the first conversion circuit unit and the second conversion circuit unit;

a data line;

an electro-optical element; and a transistor corresponding to the electro-optical element and electrically connected to the first conversion circuit unit via the data line, wherein a first area in which the first electrode and the second electrode overlap in plan view is less than half a second area in which the third electrode and the fourth electrode overlap in the plan view, an area in which the fifth electrode and the sixth electrode overlap in the plan view is substantially the same as the second area, and an area in which the seventh electrode and the eighth electrode overlap in the plan view is substantially the same as the second area, an area in which the ninth electrode and the tenth electrode overlap in the plan view is substantially the same as the first area, an area in which the eleventh electrode and the twelfth electrode overlap in the plan view is substantially the same as the second area, an area in which the thirteenth electrode and the fourteenth electrode overlap in the plan view is substantially the same as the second area, and an area in which the fifteenth electrode and the sixteenth electrode overlap in the plan view is substantially the same as the second area.

3. The electro-optical device according to claim 2, wherein the coupling capacitance includes a seventeenth electrode and an eighteenth electrode, and an area in which the seventeenth electrode and the eighteenth electrode overlap in the plan view is greater than the first area.

4. The electro-optical device according to claim 1, wherein each of the fifth electrode and the seventh electrode has an island shape, and each of the sixth electrode and the eighth electrode has an island shape.

5. The electro-optical device according to claim 1, wherein each of the fifth electrode and the seventh electrode is an individual electrode with an island shape, and the sixth electrode and the eighth electrode are common electrodes.

6. The electro-optical device according to claim 2, wherein each of the fifth electrode and the seventh electrode is an individual electrode with an island shape, and the sixth electrode and the eighth electrode are common electrodes.

7. The electro-optical device according to claim 3, wherein each of the fifth electrode and the seventh electrode is an individual electrode with an island shape, and the sixth electrode and the eighth electrode are common electrodes.

8. An electro-optical device, comprising:

a DA conversion circuit including a capacitance element unit including:

a first capacitance element corresponding to one bit of a plurality of bits; and two second capacitance elements corresponding to another bit having a greater weight than that of the one bit, of the plurality of bits;

a data line;

an electro-optical element; and a transistor corresponding to the electro-optical element and electrically connected to the DA conversion circuit via the data line, wherein an area in which one electrode and another electrode of the first capacitance element overlap in plan view is substantially the same as an area in which one electrode and another electrode of each of the two second capacitance elements overlap in the plan view, and the one electrode of each of the two second capacitance elements has an island shape, and the other electrode of each of the two second capacitance elements is a common electrode.

9. An electronic apparatus comprising the electro-optical device according to claim 1.

10. An electronic apparatus comprising the electro-optical device according to claim 2.

11. An electronic apparatus comprising the electro-optical device according to claim 8.

12. The electro-optical device according to claim 1, wherein the data line extends along a first direction, and the first capacitance element, the second capacitance element, the third capacitance element, and the fourth capacitance element are arranged along the first direction in the plan view.

13. The electro-optical device according to claim 2, wherein the data line extends along a first direction, the first capacitance element, the second capacitance element, the third capacitance element, and the fourth capacitance element are arranged along the first direction in the plan view, and the fifth capacitance element, the sixth capacitance element, the seventh capacitance element, and the eighth capacitance element are arranged along the first direction in the plan view.

14. The electro-optical device according to claim 8, wherein the data line extends along a first direction, and the first capacitance element, and the two second capacitance elements are arranged along the first direction in the plan view.

15. An electronic apparatus comprising the electro-optical device according to claim 12.

16. An electronic apparatus comprising the electro-optical device according to claim 13.

17. An electronic apparatus comprising the electro-optical device according to claim 14.

* * * * *